US009370816B2

(12) United States Patent
Sakabe et al.

(10) Patent No.: US 9,370,816 B2
(45) Date of Patent: Jun. 21, 2016

(54) INDUCTION HEATING COIL MANUFACTURING APPARATUS AND INDUCTION HEATING COIL MANUFACTURING METHOD

(75) Inventors: Hiroshi Sakabe, Mie (JP); Hiroshi Nonoyama, Mie (JP); Masayuki Koie, Mie (JP); Yasuhiro Mimura, Mie (JP); Kensuke Takao, Mie (JP)

(73) Assignee: FUJI XEROX CO., LTD., Tokyo (JP)

( * ) Notice: Subject to any disclaimer, the term of this patent is extended or adjusted under 35 U.S.C. 154(b) by 1352 days.

(21) Appl. No.: 13/206,021

(22) Filed: Aug. 9, 2011

(65) Prior Publication Data

US 2012/0037264 A1 Feb. 16, 2012

(30) Foreign Application Priority Data

Aug. 11, 2010 (JP) ..... 2010-180473
Feb. 7, 2011 (JP) ..... 2011-024314

(51) Int. Cl.
*B21F 1/00* (2006.01)
*B21C 47/04* (2006.01)
*B21F 45/00* (2006.01)

(52) U.S. Cl.
CPC . *B21F 1/00* (2013.01); *B21C 47/04* (2013.01); *B21F 45/00* (2013.01); *H01F 41/066* (2016.01); *H01F 41/082* (2016.01); *Y10T 29/49071* (2015.01)

(58) Field of Classification Search
CPC .... B21C 47/003; B21C 47/04; B21C 47/063; B21C 47/08; B21F 1/00; B21F 1/02; B21F 1/004; B21F 45/16; B21F 45/00; H01F 41/0616; H01F 41/0641; H01F 41/0612; H01F 41/0633; H01F 41/065; H01F 41/0658
See application file for complete search history.

(56) References Cited

U.S. PATENT DOCUMENTS 5,477,718 A * 12/1995 Sakamoto et al. ..... 72/79
6,401,333 B1 * 6/2002 Suzuki et al. ..... 29/848
6,752,343 B2 * 6/2004 Nagai et al. ..... 242/443
7,145,116 B2 * 12/2006 Keishima et al. ..... 219/672
2002/0029453 A1 * 3/2002 Quick et al. ..... 140/104
2003/0098380 A1 5/2003 Nagai et al.

FOREIGN PATENT DOCUMENTS

JP 01026345 A * 1/1989 ..... H02K 15/04
JP A-2000-215972 8/2000

* cited by examiner

*Primary Examiner* — Alexander P Taousakis
*Assistant Examiner* — Pradeep C Battula
(74) *Attorney, Agent, or Firm* — Oliff PLC

(57) ABSTRACT

An induction heating coil manufacturing apparatus includes a winding device that winds a wire around a winding shaft having a quadrangular cross section, and a bending device that bends the wire at a position at which the wire is to be wound around a corner of the winding shaft before the winding device winds the wire at the position around the winding shaft.

15 Claims, 16 Drawing Sheets

INDUCTION HEATING COIL MANUFACTURING APPARATUS AND INDUCTION HEATING COIL MANUFACTURING METHOD

CROSS-REFERENCE TO RELATED APPLICATIONS

This application is based on and claims priority under 35 USC 119 from Japanese Patent Application No. 2010-180473 filed Aug. 11, 2010, and No. 2011-024314 filed Feb. 7, 2011.

BACKGROUND

Technical Field

The present invention relates to an induction heating coil manufacturing apparatus and an induction heating coil manufacturing method.

SUMMARY

According to an aspect of the invention, an induction heating coil manufacturing apparatus includes a winding device that winds a wire around a winding shaft having a quadrangular cross section, and a bending device that bends the wire at a position at which the wire is to be wound around a corner of the winding shaft before the winding device winds the wire at the position around the winding shaft.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described with reference to the drawings.

Structure of Coil Manufacturing Apparatus 200

Figure 1:
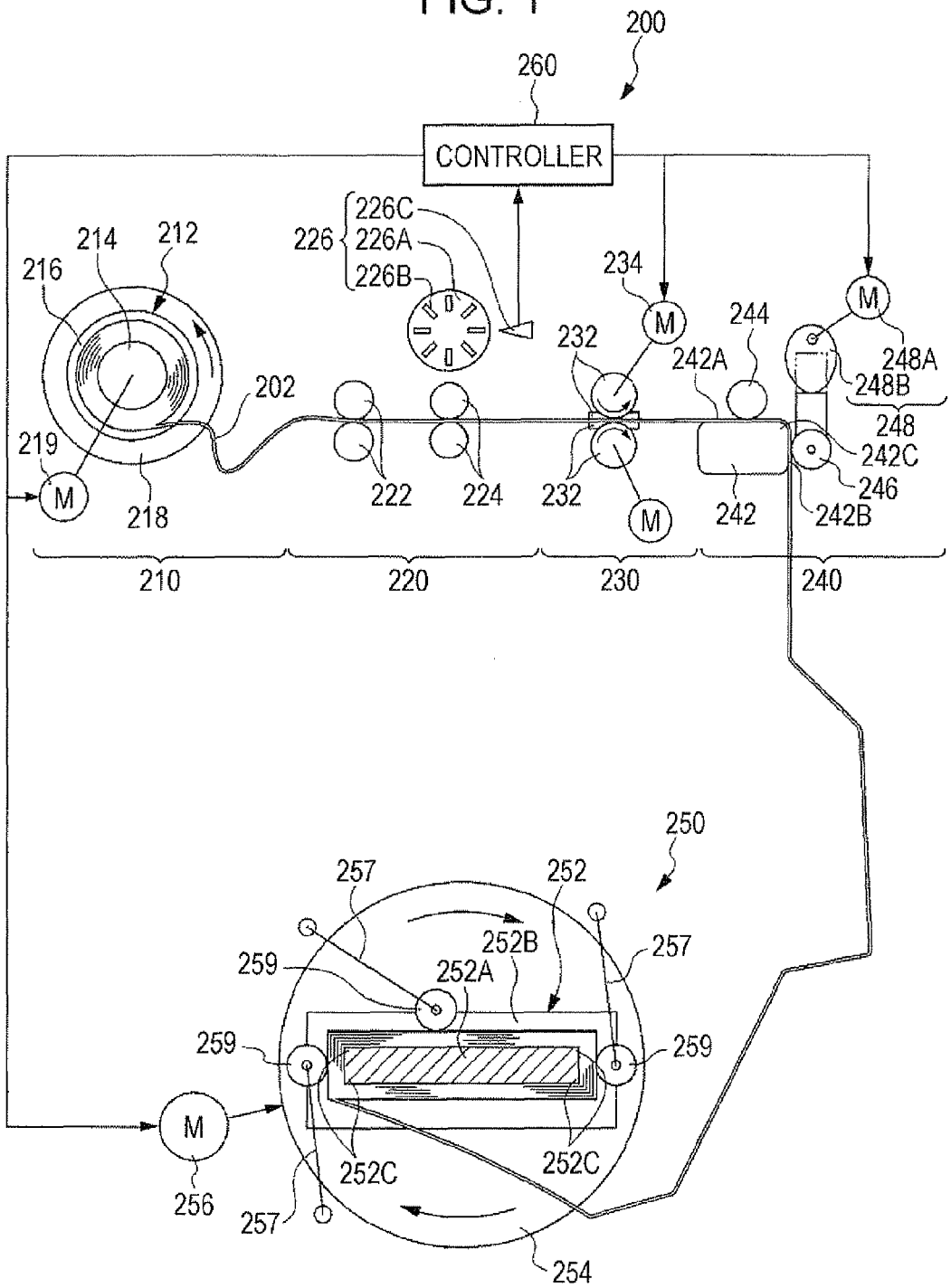
FIG. 1 is a schematic view of a coil manufacturing apparatus according to the exemplary embodiment.

First, the structure of a coil manufacturing apparatus 200 that manufactures an induction heating coil will be described. FIG. 1 is a schematic view of the coil manufacturing apparatus 200 according to the present exemplary embodiment.

As illustrated in FIG. 1, the coil manufacturing apparatus 200 includes a winding device 250 and a bending device 240. The winding device 250 winds a wire 202, which is electroconductive, around a winding shaft 252A having a quadrangular cross section (to be specific, a rectangular cross section). The bending device 240 bends the wire 202, which is to be wound by the winding device 250, beforehand at positions to be wound around corners 252C of the winding shaft 252A.

The coil manufacturing apparatus 200 further includes a wire supply unit 210, a feed unit 230, and a measuring device 220. The wire supply unit 210 supplies the wire 202, which is to be bent by the bending device 240. The feed unit 230 feeds the wire 202, which has been supplied from the wire supply unit 210, to the bending device 240. The measuring device 220 measures the feed amount of the wire 202 fed by the feed unit 230.

In the coil manufacturing apparatus 200, the wire supply unit 210, the measuring device 220, the feed unit 230, the bending device 240, and the winding device 250 are arranged in this order along the feed path of the wire 202.

Wire Supply Unit

The wire supply unit 210 includes a bobbin 212 and a bobbin holder 218. The wire 202 is wound around and held by the bobbin 212. The bobbin holder 218 is a supporter that rotatably supports the bobbin 212.

The bobbin 212 includes a winding shaft 214 and flanges 216. The wire 202 is wound around the winding shaft 214. The flanges 216 are protruding portions that protrude in the radial direction of the winding shaft 214 from both ends of the winding shaft 214 in the axial direction.

The bobbin holder 218 supports the bobbin 212 such that the bobbin 212 is rotatable around the axis of the winding shaft 214.

The bobbin holder 218 is connected to a driving motor 219 that rotates the bobbin 212 in a direction in which the wire 202 is unwound from the winding shaft 214 (counterclockwise in FIG. 1).

The wire 202 has a circular cross section, and includes stranded thin wires. Each thin wire is a so-called magnet wire (enameled wire), which includes a conductor through which an electric current passes and an insulating film that covers the conductor. The wire 202 is constituted by forty-five or ninety thin lines.

Measuring Apparatus

The measuring device 220 includes back tension rollers 222, which are examples of a tension applying member. The back tension rollers 222 apply a tension to the wire 202, which is fed toward the feed unit 230, at a position upstream of the feed unit 230 in the feed direction of the wire 202. To be specific, the back tension rollers 222 are a pair of rollers that nip the wire 202 therebetween. The back tension rollers 222 are rotated by the wire 202 nipped between the back tension rollers 222 when a predetermined torque is applied from the wire 202 to the back tension rollers 222. That is, until the predetermined toque is applied by the wire 202, the back tension rollers 222 are not rotated by the wire 202 and apply a resistance to the wire 202, thereby applying a tension to the wire 202 between the back tension rollers 222 and the feed unit 230.

The tension applying member is not limited to the back tension rollers 222. Any tension applying member that applies a tension to the wire 202 by contacting the wire 202, for example, may be used.

Driven rollers 224 are disposed upstream of the feed unit 230 in the feed direction of the wire 202 and downstream of the back tension rollers 222 in the feed direction of the wire 202. The driven rollers 224 are rotated by the wire 202, which is fed by the feed unit 230.

The driven rollers 224 does not easily slip at a contact point at which the driven rollers 224 contact the wire 202 because the material of the driven rollers 224 is appropriately selected and the pressure with which the driven rollers 224 press the wire 202 is appropriately adjusted. As a result, the driven rollers 224 are rotated by the wire 202 as the wire 202 is fed.

Because the back tension rollers 222 apply a tension to the wire 202, the wire 202 between the feed unit 230 and the back tension rollers 222 does not become loose, and the amount of the wire 202 fed by the feed unit 230 does not deviate from the amount of the wire 202 that passes the position at which the wire 202 is in contact with the driven rollers 224.

A rotary encoder 226 for measuring the rotation amount (number of rotations) of the driven rollers 224 is coupled to the driven rollers 224. The rotary encoder 226 includes a disk 226A that is disposed on the rotary shaft of the driven rollers 224 or on a rotary shaft that is rotated by the driven rollers 224 through a gear or the like. The disk 226A has slits 226B that extend in the radial direction and that are arranged in the circumferential direction at a predetermined pitch.

The rotary encoder 226 further includes a photointerrupter 226C having a light emitter (not shown) and a light receiver (not shown). The photointerrupter 226C is an example of a detector.

The photointerrupter 226C counts the number of the slits 226B that pass between the light emitter and the light receiver by receiving light that is emitted by the light emitter and that passes through the slits 226B, and thereby measures the rotation amount (number of rotations) of the driven rollers 224, i.e., the feed amount of the wire 202.

To be specific, the photointerrupter 226C sends a detection signal (pulse signal) generated by receiving light that has passed through the slits 226B to a controller 260, which is connected to the photointerrupter 226C. The controller 260 will be described below.

Feed Unit

Figure 2:
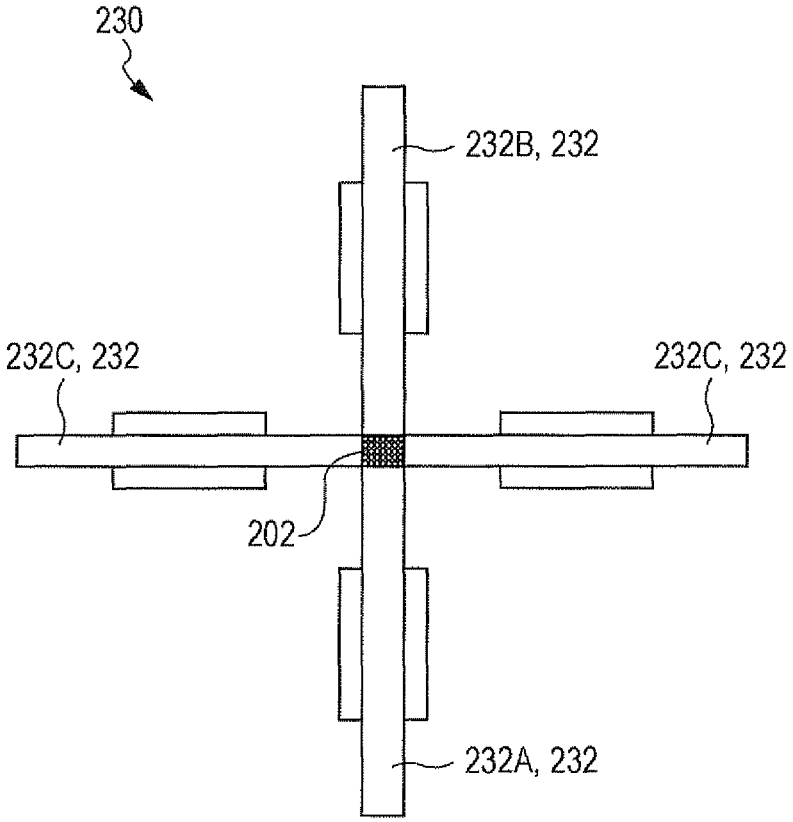
FIG. 2 is a schematic view of a feed unit according to the exemplary embodiment.

FIG. 2 illustrates the feed unit 230 seen from the upstream side in the feed direction (from the left side in FIG. 1). The feed unit 230 includes four feed rollers 232 that pinch the wire 202 from four directions and feed the wire 202. To be specific, the four feed rollers 232 include a feed roller 232A, a feed roller 232B, and two feed rollers 232C. The feed roller 232B contacts the wire 202 in a direction (downward in FIG. 2) that is opposite to the direction in which the feed roller 232A contacts the wire 202 (downward in FIG. 2). The feed rollers 232C face each other in directions (perpendicular to the plane of FIG. 2) that are perpendicular to the directions in which the feed rollers 232A and 232B contact the wire 202 (vertical directions in FIG. 2) and contact the wire 202 in the directions.

As illustrated in FIG. 1, the feed rollers 232 are connected to driving motors 234 that rotate the feed rollers 232. The driving motors 234 are examples of a driver. The feed rollers 232 are rotated by the driving motors 234 at the same rotation speed (circumferential speed).

The feed rollers 232 feed the wire 202 while pinching and pressing the outer peripheral surface of the wire 202 from four directions and thereby forming the wire 202 into a shape having a quadrangular cross section (forming a rectangular wire). Here, the term "forming the wire 202 into a shape having a quadrangular cross section (forming a rectangular wire)" refers to change the cross-sectional shape of the wire 202 from circular to quadrangular or to change the cross-sectional shape of the wire 202 from circular to substantially quadrangular.

In the present exemplary embodiment, the width of the outer peripheral surfaces of the feed rollers 232A and 232B, which face each other, in the axial direction thereof (horizontal directions in FIG. 2) is larger than the width of the outer peripheral surfaces of the feed rollers 232C, which face each other, in the axial direction thereof (vertical directions in FIG. 2). Therefore, the wire 202 is formed into a shape having a rectangular cross section.

Bending Device

Figure 3A:
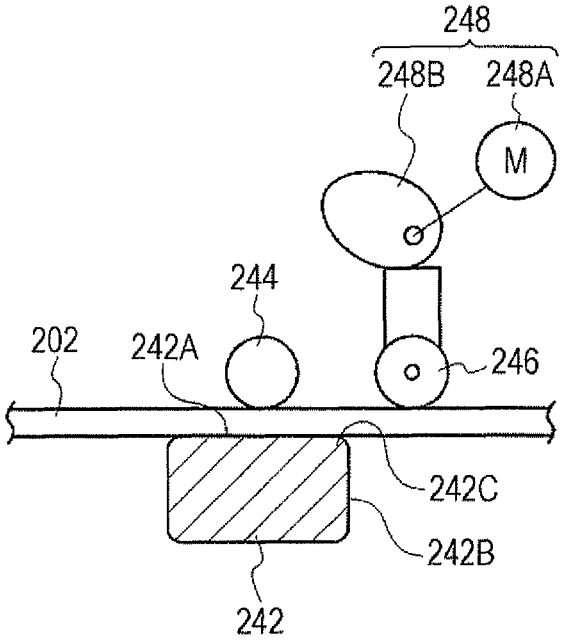
FIGS. 3A and 3B are schematic views of a bending device according to the exemplary embodiment.
Figure 3B:
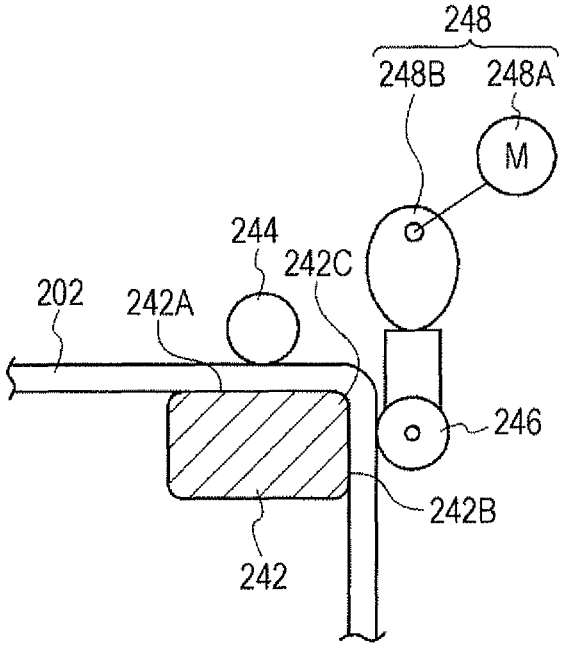

As illustrated in FIGS. 3A and 3B, the bending device 240 includes a block 242 having a quadrangular cross section (to be specific, a rectangular cross section). Here, the term "quadrangular cross section" of the block 242 refers to a cross-sectional shape that is surrounded by four sides and that has corners 242C between adjacent sides. The corners 242C may be rounded. The term "rectangular cross section" of the block 242 refers to a cross-sectional shape that is surrounded by a pair of short sides facing each other and a pair of long sides facing each other and that has corners 242C between the short sides and the long sides. The corners 242C may be rounded. In the case where the corners 242C are rounded, the radii of the corners 242C may as small as about three millimeters.

A pressing roller 244 is disposed so as to face a first surface 242A (upper surface in FIGS. 3A and 3B) of the block 242. The pressing roller 244, which is an example of a pressing member, presses the wire 202 against the first surface 242A.

A pressure roller 246 is disposed downstream of the pressing roller 244 in the feed direction of the wire 202 (right side in FIGS. 3A and 3B). The pressure roller 246, which is an example of a pressing member, presses the wire 202 against a second surface 242B, which is perpendicular to the first surface 242A.

A driving mechanism 248 is attached to the pressure roller 246. The driving mechanism 248 moves the pressure roller 246 along the second surface 242B between a facing position (FIG. 3B), at which the pressure roller 246 faces the second surface 242B, and a retracted position (FIG. 3A), at which the pressure roller 246 is retracted from the facing position toward the pressing roller 244.

The driving mechanism 248 includes an elastic member (not shown), a cam 248B, and a driving motor 248A. The elastic member, which is an extension spring or the like, generates an elastic force and pushes or pulls the pressure roller 246 between the facing position and the retracted position. The cam 248B moves the pressure roller 246 to the facing position against the elastic force of the elastic member. The driving motor 248A rotates the cam 248B.

The pressing roller 244 presses the wire 202 against the first surface 242A. The pressure roller 246, which moves from the retracted position to the facing position as the cam 248B rotates, presses a part of the wire 202 that extends beyond the first surface 242A (toward the second surface 242B or rightward in FIG. 3A) against the second surface 242B (FIG. 3B). As a result, the bending device 240 bends the wire 202 along the corner 242C between the first surface 242A and the second surface 242B.

Winding Device

Figure 4A:
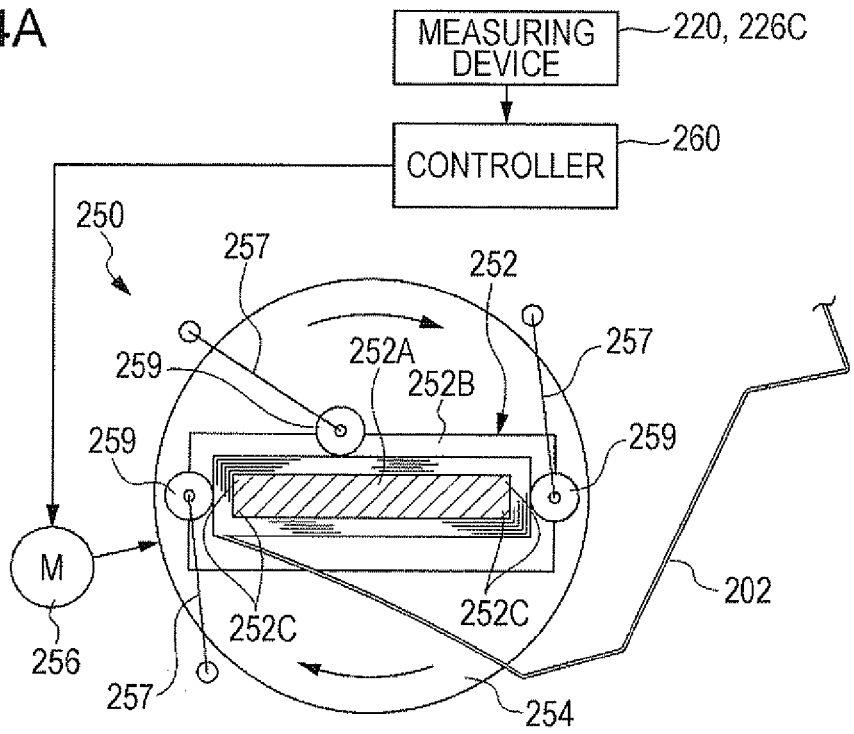
FIGS. 4A and 4B are front views of a winding device according to the exemplary embodiment.
Figure 4B:
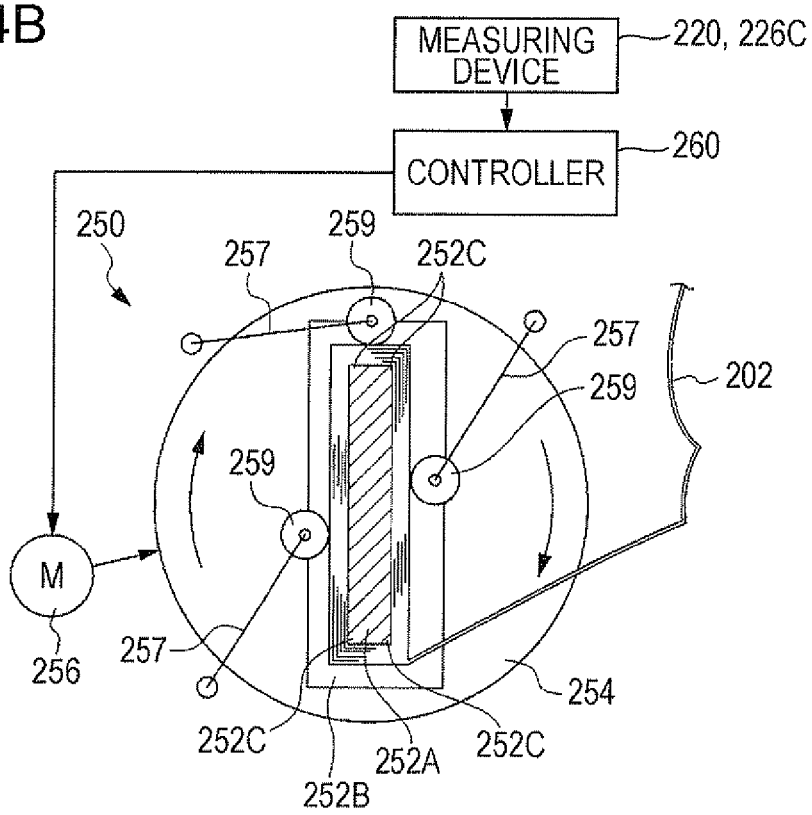

As illustrated in FIGS. 4A and 4B, the winding device 250 includes a rotor 254, a driving motor 256, and a winder 252. The rotor 254 is rotatably supported by a supporter (not shown). The driving motor 256 rotates the rotor 254. The winder 252, which is fixed to the rotor 254, rotates together with the rotor 254 and winds the wire 202. The rotor 254 has a circular shape in front view illustrated in FIGS. 4A and 4B (when seen from one side in the axial direction of the rotor 254).

The winder 252 includes the winding shaft 252A and a pair of flanges 252B. The winding shaft 252A has a quadrangular cross section (to be specific, a rectangular cross section) in a front view. The pair of flanges 252B are protruding portions that protrude in directions perpendicular to the axial direction of the winding shaft 252A from both ends of the winding shaft 252A in the axial direction.

Here, the term "quadrangular cross section" of the winding shaft 252A refers to a cross-sectional shape that is surrounded by four sides and that has corners 252C between adjacent sides. The corners 252C may be rounded. The term "rectangular cross section" of the winding shaft 252A refers to a cross-sectional shape that is surrounded by a pair of short sides facing each other and a pair of long sides facing each other and that has the corners 252C between the short sides and the long sides. The corners 252C may be rounded. In the case where the corners 252C are rounded, the radii of the corners 252C may be as small as about three millimeters.

Figure 5:
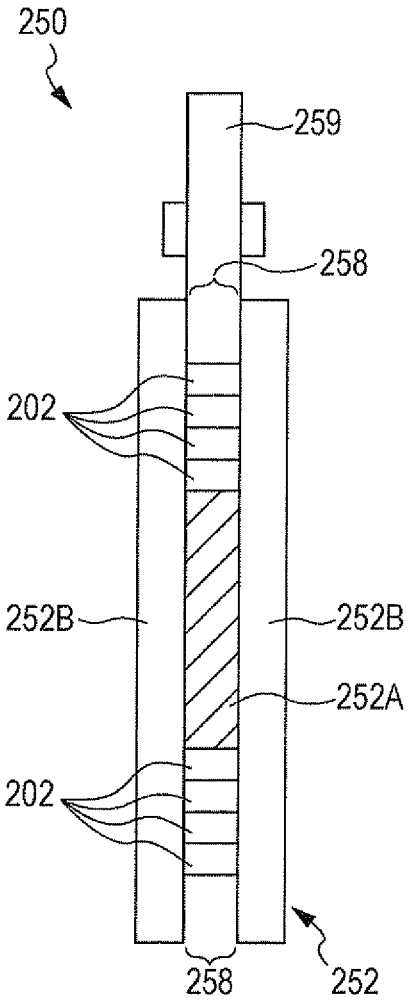
FIG. 5 is a side view of the winding device according to the exemplary embodiment.

As illustrated in FIG. 5, a groove 258 is formed between the pair of flanges 252B. The wire 202 that is wound around the winding shaft 252A is held in the groove 258.

As illustrated in FIGS. 4A and 4B, three pushing rollers 259 are attached to the supporter (not shown), on which the rotor 254 is supported. The pushing rollers 259, which are examples of a pushing member, align and push the wire 202 into the groove 258 in directions (vertical directions in FIG. 5) perpendicular to the axial direction of the winding shaft 252A (horizontal directions in FIG. 5).

Each of the pushing rollers 259 is supported by the supporter (not shown) through a plate spring 257, which is an elastic member. The pushing roller 259 is pressed against the winding shaft 252A by an elastic force of the plate spring 257 so that the pushing roller 259 enters the groove 258. The three pushing rollers 259 are disposed so that the pushing rollers 259 contact the winding shaft 252A from three directions (from above, left, and right in FIGS. 4A and 4B).

As illustrated in FIGS. 4A and 4B, even when the orientation of the winder 252 changes as the rotor 254 rotates, the pushing rollers 259 follow the winding shaft 252A due to the elastic force of the plate spring 257. Therefore, the winding device 250 is configured so that the wire 202 is continuously pressed against the winding shaft 252A.

At least one of the pair of flanges 252B is movable toward the other of the flanges 252B (one of the horizontal directions in FIG. 5), so that the flanges 252B press the wire 202 wound around the winding shaft 252A in the axial direction of the winding shaft 252A, thereby forming the wire 202. That is, the flanges 252B, which serves as a compressing member, compress the wire 202, which is wound around the winding shaft 252A, in the axial direction of the winding shaft 252A and thereby form the wire 202. A bent portion of the wire 202, which has been bent by the bending device 240, is expanded in the axial direction of the winding shaft 252A. However, such an expansion of the wire 202 is eliminated when the wire 202 is compressed by the compressing member.

Controller

The controller 260 controls the driving motor 219 of the wire supply unit 210, the driving motors 234 of the feed unit 230, the driving mechanism 248 of the bending device 240, and the driving motor 256 of the winding device 250 on the basis of a detection signal obtained from the photointerrupter 226C.

To be specific, the controller 260 causes the driving motors 234 of the feed unit 230 to rotate the feed rollers 232. When the controller 260 detects that a predetermined amount of the wire 202 has been fed on the basis of the detection signal from the photointerrupter 226C, the controller 260 causes the driving motors 234 to stop the feed rollers 232.

The predetermined feed amount is set such that positions of the wire 202 to be wound around the corner 252C of the winding shaft 252A are stopped at the corners 242C of the block 242, at which the bending device 240 bends the wire 202.

The positions at which the wire 202 are wound around the corners 252C of the winding shaft 252A include positions at which the wire 202 is directly wound around the corners 252C and positions at which the wire 202 is wound around the corners 252C over other turns of the wire 202.

The controller 260 causes the driving motor 219 of the wire supply unit 210 to rotate the bobbin 212 in sync with rotation of the feed rollers 232.

In a state in which the feed rollers 232 are stopped, the controller 260 causes the driving mechanism 248 of the bending device 240 to move the pressure roller 246 from the retracted position to the facing position, bend the wire 202, move the pressure roller 246 from the facing position to the retracted position, and stop the pressure roller 246.

On the basis of the detected signal sent from the photointerrupter 226C, the controller 260 causes the driving motor 256 to rotate the winding shaft 252A so that the wire 202, which has been bent by the bonding device 240, is wound around the winding shaft 252A in a state in which the wire 202 is not under tension between the bending device 240 and the winding device 250. To be specific, the winding shaft 252A is started to be rotated when the wire 202 is fed downstream from the bending device 240 by an amount that is larger than a distance from the bending device 240 (block 242) to the winding device 250 (winding shaft 252A) along the path of the wire 202, and the winding shaft 252A is rotated by an amount that is smaller than the distance.

An induction heating coil that is manufactured by the coil manufacturing apparatus 200 according to the present exemplary embodiment is used for heating using the principle of electromagnetic induction. An image forming apparatus will be described below as an example of an apparatus including the induction heating coil.

Method of Manufacturing Induction Heating Coil by Using Coil Manufacturing Apparatus 200

A method (process) of manufacturing an induction heating coil by using the coil manufacturing apparatus 200 will be described.

Forming Process

In the coil manufacturing apparatus 200, the wire 202 is supplied from the bobbin 212 of the wire supply unit 210 and is fed to the bending device 240 by the feed rollers 232 of the feed unit 230.

At this time, the wire 202 is compressed by the four feed rollers 232 and fed while being formed into a shape having a quadrangular cross section. That is, the wire 202 is compressed and formed into a shape having a quadrangular cross section before being bent.

Bending Process

Feeding of the wire 202 is stopped when a position of the wire 202 to be wound around the corner 252C of the winding shaft 252A arrives at the corner 242C of the block 242.

The pressing roller 244 presses the wire 202 against the first surface 242A. As the cam 248B rotates, a part of the wire 202 that extends beyond the first surface 242A toward the second surface 242B (right side in FIG. 3A) is pressed against the second surface 242B by the pressure roller 246 that moves from the retracted position to the facing position (FIG. 3B), whereby the wire 202 is bent along the corner 242C between the first surface 242A and the second surface 242B.

Thus, the wire 202 is bent at the position at which the wire is to be wound around the corner 252C of the winding shaft 252A.

Winding Process

The wire 202, which has been bent, is fed to the winding device 250 and wound around the winding shaft 252A.

In the winding process, the wire 202, which has been bent in the bending process, is wound in a state in which the wire 202 is not under tension between the bending device 240 (block 242) and the winding device 250 (winding shaft 252A).

Forming Process

The wire 202, which has been wound around the winding shaft 252A in the winding process, is formed by being compressed by the flanges 252B in the axial direction of the winding shaft 252A. Parts of the wire 202 that have been bent in the bending process protrude in directions perpendicular to the plane of FIGS. 3A and 3B as compared with the other parts of the wire 202. However, such protrusions are eliminated by being compressed in the forming process.

Figure 6A:
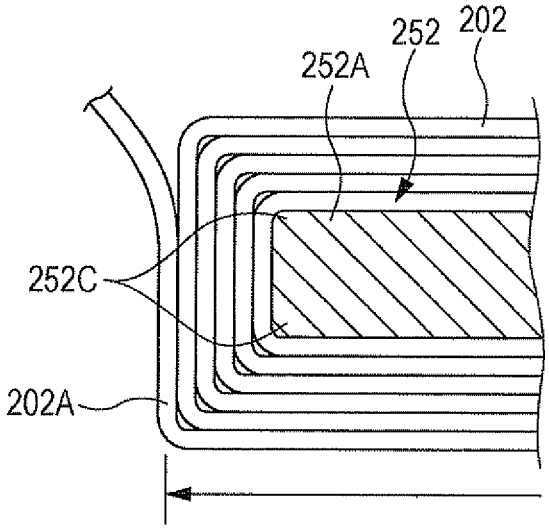
FIG. 6A is a schematic view illustrating a state in which a wire is wound around a winding shaft according to the exemplary embodiment.

Thus, an induction heating coil is manufactured by the coil manufacturing apparatus 200. In the present exemplary embodiment, the wire 202 is bent beforehand at positions at which the wire 202 is to be wound around the corners 252C of the winding shaft 252A. Therefore, as illustrated in FIG. 6A, the wire 202 is wound so as to follow the cross-sectional shape of the winding shaft 252A.

Figure 6B:
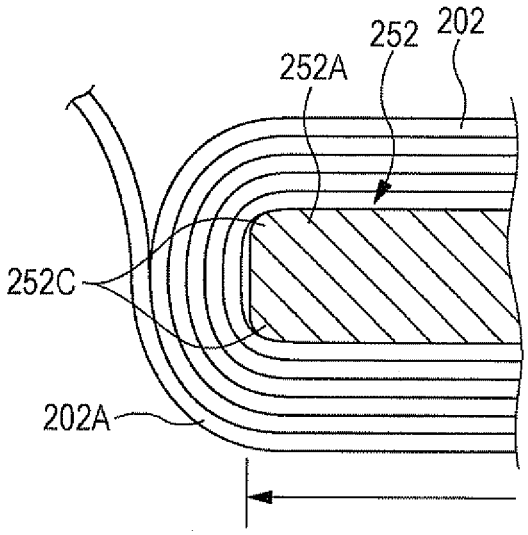
FIG. 6B is a schematic view illustrating a state in which a wire is wound around a winding shaft according to a comparative example.

In contrast, as illustrated in FIG. 6B, in a comparative example in which the wire 202 is not bent beforehand at positions at which the wire 202 is to be wound around the corners 252C of the winding shaft 252A, the coil of the wire 202 expands in a rounded shape at the corners 252C. The farther the wire 202 from the winding shaft 252A, the larger the coil of the wire 202 expands.

Therefore, as compared with the comparative example described above, the present exemplary embodiment ensures linearity of a linear portion 202A of the wire 202 that is linearly wound around the winding shaft 252A. Thus, as compared with the comparative example, the proportion of the length of the linear portion 202A, which contributes to heat generation, to the total length of the induction heating coil is large in the present exemplary embodiment.

In the present exemplary embodiment, the wire 202 is wound in a state in which the part of the wire 202 between the bending device 240 (block 242) and the winding device 250 (winding shaft 252A) is not under tension. Therefore, as compared with the case where the wire 202 is wound while being stretched, the wire 202 that has been bent does not recover to its original shape. Thus, the wire 202 is wound around the winding shaft 252A while maintaining its bent shape.

In the present exemplary embodiment, the pushing rollers 259 push the wire 202 into the groove 258 of the winder 252. Therefore, as compared with the case where the wire 202 is not pushed into the groove 258, the wire 202 is densely arranged in a direction perpendicular to the axial direction of the winding shaft 252A.

In the present exemplary embodiment, the wire 202 wound around the winding shaft 252A is compressed by the flanges 252B in the axial direction of the winding shaft 252A. Therefore, as compared with the case where the wire 202 is not compressed in the axial direction of the winding shaft 252A, expansion of bent portions of the wire 202 in the axial direction of the winding shaft is reduced.

In the present exemplary embodiment, the wire 202 is compressed and formed into a shape having a quadrangular cross section before being bent. Therefore, as compared with the case where the wire 202 is not formed into a shape having a quadrangular cross section, the wire 202 is densely arranged in a direction perpendicular to the axial direction of the winding shaft 252A. In the present exemplary embodiment, the wire 202 has been bent into a shape having a quadrangular cross section before being bent. Therefore, a force applied by the flanges 252B of the winding device 250 to the wire 202 may be small.

Another Bending Device

Figure 7A:
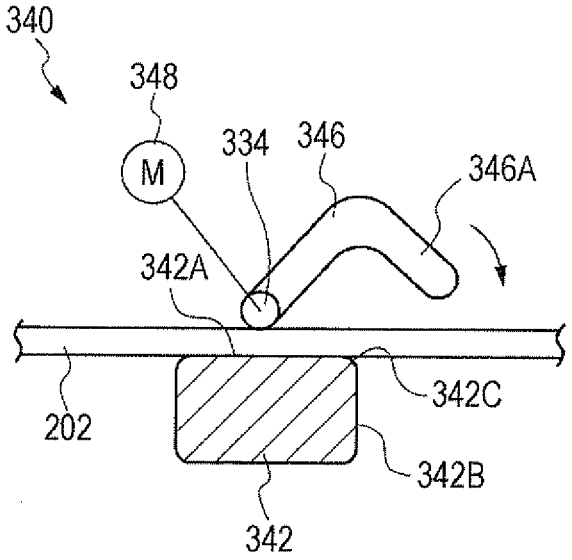
FIGS. 7A and 7B are schematic views of another bending device.
Figure 7B:
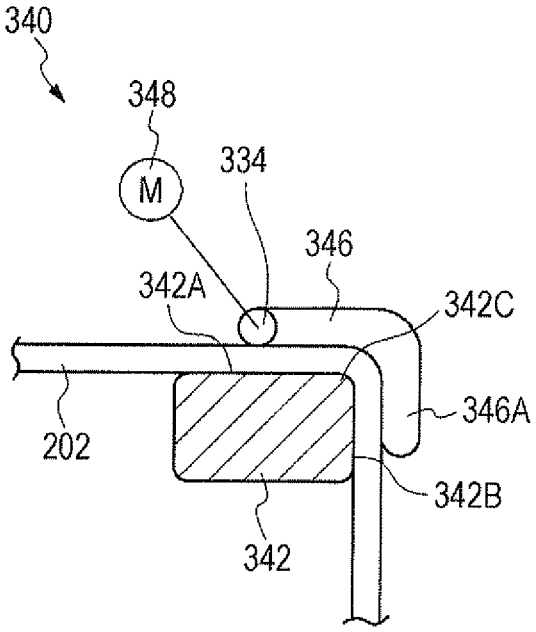

Instead of the bending device 240, a bending device 340 illustrated in FIGS. 7A and 7B may be used. As illustrated in FIGS. 7A and 7B, the bending device 340 includes a block 342 having a quadrangular cross section (to be specific, a rectangular cross section). The term "quadrangular cross section" of the block 342 refers to a cross-sectional shape that is surrounded by four sides and that has corners 342C between adjacent sides. The corners 342C may be rounded. The term "rectangular cross section" of the block 342 refers to a cross-sectional shape that is surrounded by a pair of short sides facing each other and a pair of long sides facing each other and that has corners 342C between the short sides and the long sides. The corner 342C may be rounded.

The bending device 340 includes a rotary member 346 having a rotary shaft 334 that is disposed at a position facing the first surface 342A (upper surface in FIGS. 7A and 7B) of the block 342. The rotary shaft 334 serves as a pressing member the presses the wire 202 against the first surface 342A. The rotary shaft 334 is connected to a driving motor 348 that rotates the rotary shaft 334.

The rotary member 346 has an L-shape corresponding to the shape of the corner 342C. When the rotary shaft 334 is rotated by the driving motor 348, the rotary member 346 is moved between a facing position (FIG. 7B), at which the leading end 346A faces the second surface 342B perpendicular to the first surface 342A, and a retracted position (FIG. 7A), at which the leading end 346A is retracted toward the pressing member (rotary shaft 334).

With the bending device 340, the rotary shaft 334 presses the wire 202 against the first surface 342A. The leading end 346A of the rotary member 346, which moves from the retracted position to the facing position as the rotary shaft 334 rotates, presses a part of the wire 202 that extends beyond the first surface 342A (toward the second surface 342B or rightward in FIG. 7A) against the second surface 342B (FIG. 7B).

As a result, the bending device 340 bends the wire 202 along the corner 342C between the first surface 342A and the second surface 342B.

Structure of Image Forming Apparatus 10

Figure 8:
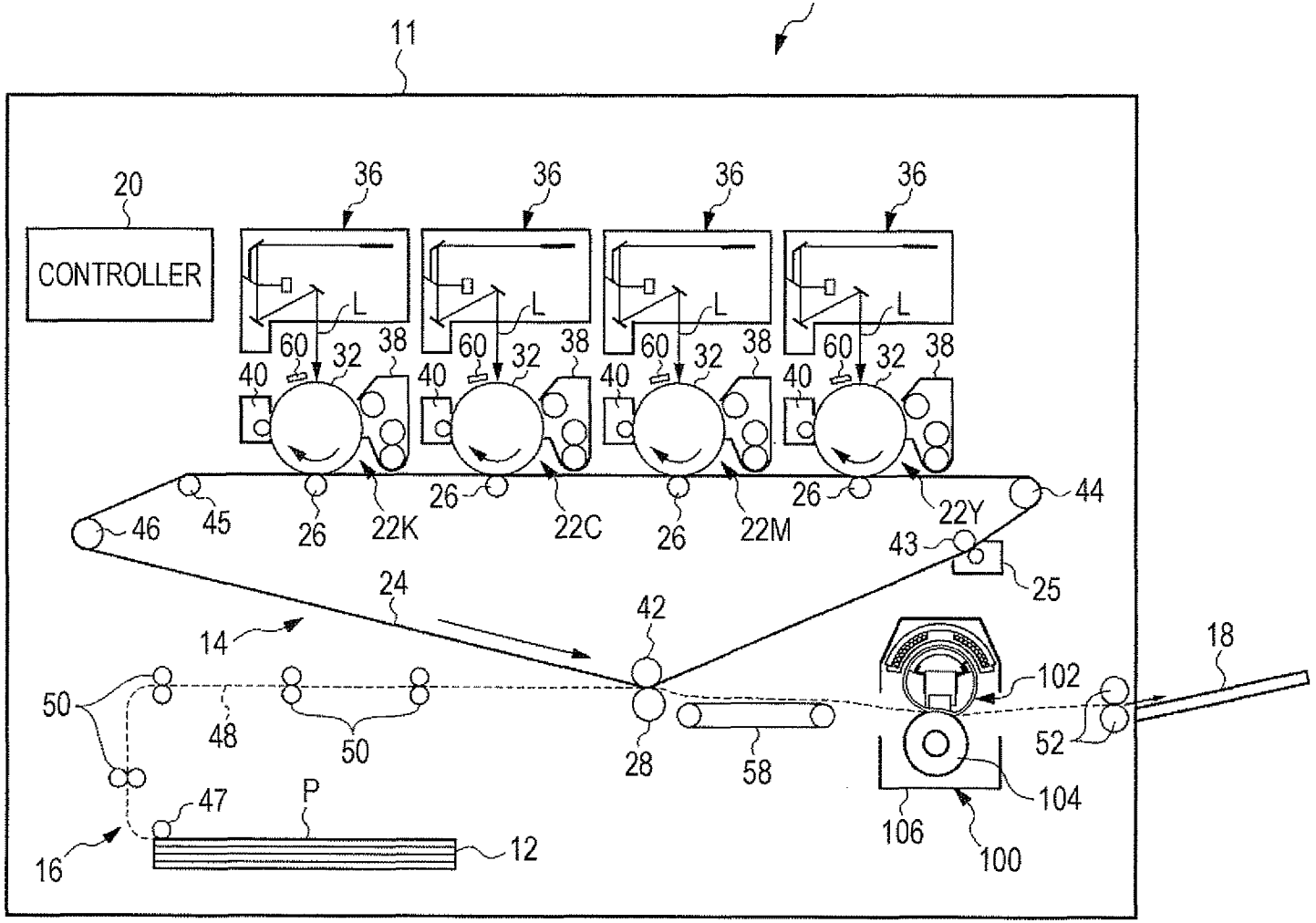
FIG. 8 is a schematic view of an image forming apparatus including an induction heating coil manufactured by the coil manufacturing apparatus.

The structure of an image forming apparatus 10 including an induction heating coil manufactured by the coil manufacturing apparatus 200 will be described. FIG. 8 is a schematic view of the image forming apparatus 10 according to the present exemplary embodiment.

As illustrated in FIG. 8, the image forming apparatus 10 includes an image forming apparatus body 11 in which the components of the image forming apparatus 10 are disposed. A recording medium container 12, an image forming section 14, a transport section 16, and a controller 20 are disposed in the image forming apparatus body 11. The recording medium container 12 contains a recording medium P, such as a sheet. The image forming section 14 forms an image on the recording medium P. The transport section 16 transports the recording medium P from the recording medium container 12 to the image forming section 14. The controller 20 controls components the image forming apparatus 10. A recording medium output tray 18 is disposed on a side of the image forming apparatus body 11. The recording medium P on which an image has been formed by the image forming section 14 is output to the recording medium output tray 18.

The image forming section 14 includes image forming units 22Y, 22M, 22C, and 22K; an intermediate transfer belt 24; a first transfer roller 26; a second transfer roller 28; and a fixing unit 100. The image forming units 22Y, 22M, 22C, 22K (hereinafter referred to as the image forming units 22Y to 22K) respective form yellow (Y), magenta (M), cyan C, and black (K) toner images. The toner images formed by the image forming units 22Y to 22K are transferred to the intermediate transfer belt 24. The first transfer roller 26, which is an example of a first transfer member, transfers the toner images formed by the image forming units 22Y to 22K to the intermediate transfer belt 24. The second transfer roller 28, which is an example of a second transfer member, transfers the toner images, which have been transferred to the intermediate transfer belt 24 by the first transfer roller 26, from the intermediate transfer belt 24 to the recording medium P. The fixing unit 100 fixes the toner images, which have been transferred from the intermediate transfer belt 24 to the recording medium P by the second transfer roller 28, onto the recording medium P.

The image forming units 22Y to 22K are arranged in a horizontal direction. Each of the image forming units 22Y to 22K includes a photoconductor 32 that rotates in one direction (clockwise in FIG. 8).

A charger 60, an exposure device 36, a developing device 38, and a cleaner 40 are arranged around the photoconductor 32 in this order from upstream in the rotation direction of the photoconductor 32. The charger 60 charges the photoconductor 32. The exposure device 36 exposes the photoconductor 32, which has been charged by the charger 60, to light, and thereby forms an electrostatic latent image on the photoconductor 32. The developing device 38 develops the electrostatic latent image, which has been formed on the photoconductor 32 by the exposure device 36, and thereby forms a toner image on the photoconductor 32. The cleaner 40 removes developer that remains on the photoconductor 32 after the toner image has been transferred to the intermediate transfer belt 24.

The exposure device 36 forms the electrostatic latent image on the basis of image information sent from the controller 20. The image information, which is sent from the controller 20, may be generated by an external apparatus and then obtained by the controller 20 or may be generated in the image forming apparatus 10 by reading an image of a document or the like. In FIG. 8, exposure light emitted from the exposure device 36 is indicated by arrow L.

The intermediate transfer belt 24, which is looped, is disposed below the image forming units 22Y to 22K. The intermediate transfer belt 24 is looped over support rollers 42, 43, 44, 45, and 46, which are disposed inside the intermediate transfer belt 24. The intermediate transfer belt 24 is driven by some of the support rollers 42, 43, 44, 45, and 46, and rotates in one direction (counterclockwise FIG. 8) in contact with the photoconductor 32. The support roller 42 faces the second transfer roller 28 with the intermediate transfer belt 24 therebetween.

A cleaner 25 is disposed outside the intermediate transfer belt 24 so as to face the support roller 43 with the intermediate transfer belt 24 therebetween. The cleaner 25 contacts the outer peripheral surface of the intermediate transfer belt 24 and removes developer that remains on the intermediate transfer belt 24 after toner images have been transferred to the recording medium P.

The first transfer roller 26 faces the photoconductor 32 with the intermediate transfer belt 24 therebetween. A toner image formed on the photoconductor 32 is transferred to the intermediate transfer belt 24 at a first transfer position between the first transfer roller 26 and the photoconductor 32.

The second transfer roller 28 faces the support roller 42 with the intermediate transfer belt 24 therebetween. The toner image transferred to the intermediate transfer belt 24 is transferred to the recording medium P at a second transfer position between the second transfer roller 28 and the support roller 42.

The transport section 16 includes a feed roller 47, a transport path 48, and transport rollers 50. The feed roller 47 feeds a recording medium P contained in the recording medium container 12. The recording medium P fed by the feed roller 47 is transported along the transport path 48. The transport rollers 50, which are arranged along the transport path 48, transport the recording medium P fed by the feed roller 47 to the second transfer position.

A transfer belt 58 is disposed downstream of the second transfer position in the transport direction. The transfer belt 58 transports the recording medium P, to which the toner image has been transferred at the second transfer position, to the fixing unit 100.

The fixing unit 100 is disposed downstream of the transfer belt 58 in the transport direction. The fixing unit 100 fixes the toner image, which has been transferred to the recording medium P, onto the recording medium P transported from the transfer belt 58. An output roller 52 is disposed downstream of the fixing unit 100 in the transport direction. The output roller 52 outputs the recording medium P, onto which the toner image has been fixed, to the recording medium output tray 18.

Next, the process of forming an image on the recording medium P, which is performed by the image forming apparatus 10, will be described.

In the image forming apparatus 10, the feed roller 47 feeds the recording medium P from the recording medium container 12, and the transport rollers 50 transport the recording medium P to the second transfer position.

In each of the image forming units 22Y to 22K, the charger 60 charges the photoconductor 32, and the exposure device 36 exposes the photoconductor 32 to light and forms an electrostatic latent image on the photoconductor 32. The developing device 38 develops the electrostatic latent image and forms a single-color toner image on the photoconductor 32. The single-color toner images, which have been formed by the image forming units 22Y to 22K, are transferred to the intermediate transfer belt 24 at the first transfer position so as to overlap each other, and thereby a color image is formed. The color image, which has been formed on the intermediate transfer belt 24, is transferred to the recording medium P at the second transfer position.

The recording medium P, to which the toner image has been transferred, is transported to the fixing unit 100, and the fixing unit 100 fixes the toner image. The output roller 52 outputs the recording medium P, onto which the toner image has been fixed, to the recording medium output tray 18. The image forming process is performed as described above.

Structure of Fixing Unit 100

Figure 9:
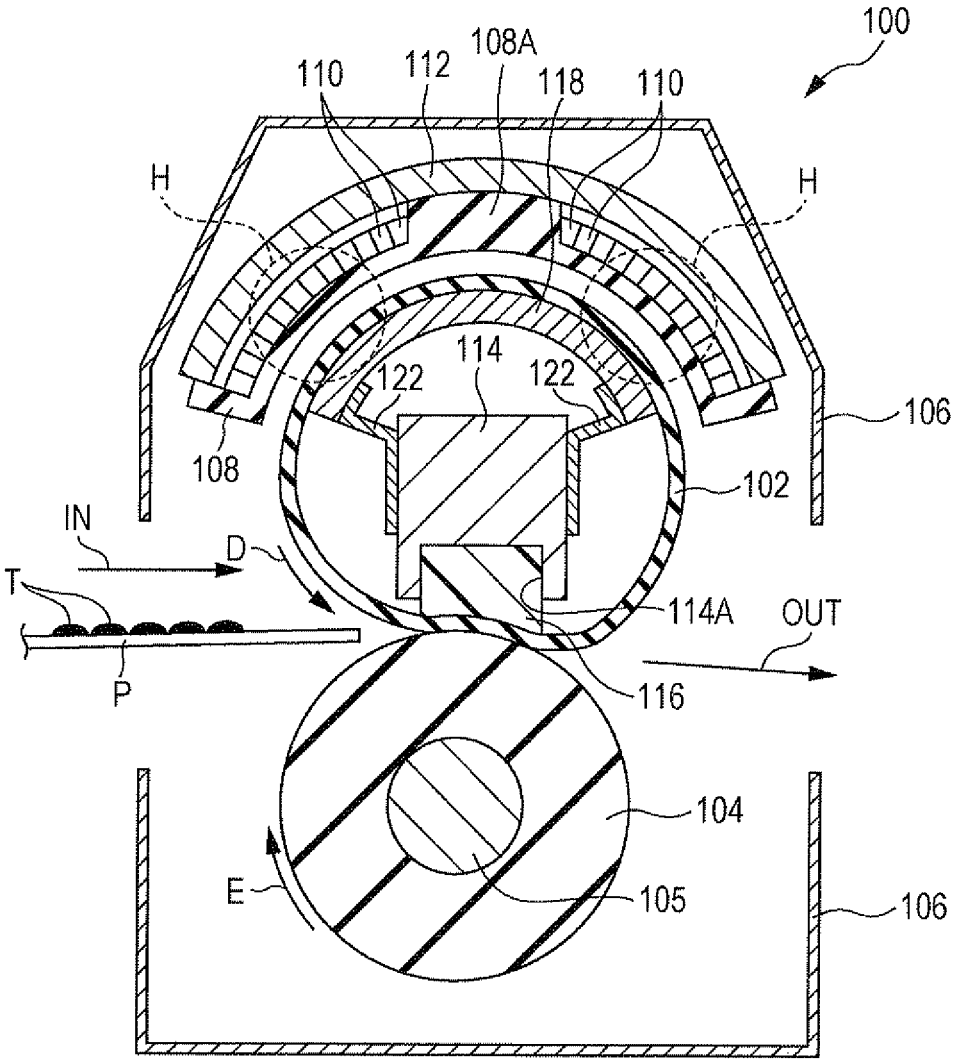
FIG. 9 is a sectional view of a fixing unit of the image forming apparatus illustrated in FIG. 8.

The structure of the fixing unit 100 will be described. FIG. 9 is a schematic view of the fixing unit 100.

As illustrated in FIG. 9, the fixing unit 100 includes a housing 106. The housing 106 has an opening through which the recording medium P enters the fixing unit 100 and an opening through which the recording medium P exits the fixing unit 100. A fixing belt 102 is disposed in the housing 106. The fixing belt 102 is an endless belt that is supported so as to be rotatable in one direction (in the direction of arrow D in FIG. 9).

A bobbin 108, which is made of an insulating material, is disposed at a position facing the outer peripheral surface of the fixing belt 102. The bobbin 108 has a substantially arc shape corresponding to the outer peripheral surface of the fixing belt 102. The bobbin 108 has a protruding portion 108A that protrudes in a direction opposite to the fixing belt 102 (upward in FIG. 9).

In plan view (top view), the protruding portion 108A of the bobbin 108 has a rectangular shape having long sides extending in a direction perpendicular to the transport direction of the recording medium P. An excitation coil 110, having plural turns, is wound around the protruding portion 108A. The excitation coil 110 generates a magnetic field H when energized. To be specific, the excitation coil 110 has a rectangular shape in plan view, and the short sides thereof extend in the transport direction of the recording medium P (horizontal direction in FIG. 9) and the long sides thereof extend in a direction perpendicular to the transport direction of the recording medium P (direction perpendicular to the plane of FIG. 9). The excitation coil 110 corresponds to an induction heating coil that is manufactured by the coil manufacturing apparatus 200.

Magnetic path forming members 112 are supported on a side of the bobbin 108 opposite to the fixing belt 102 side (upper side in FIG. 9) so as to face the excitation coil 110. Each of the magnetic path forming members 112 is formed by a magnetic substance such as a ferrite and has a substantially arc shape corresponding to the arc shape of the bobbin 108.

Figure 10:
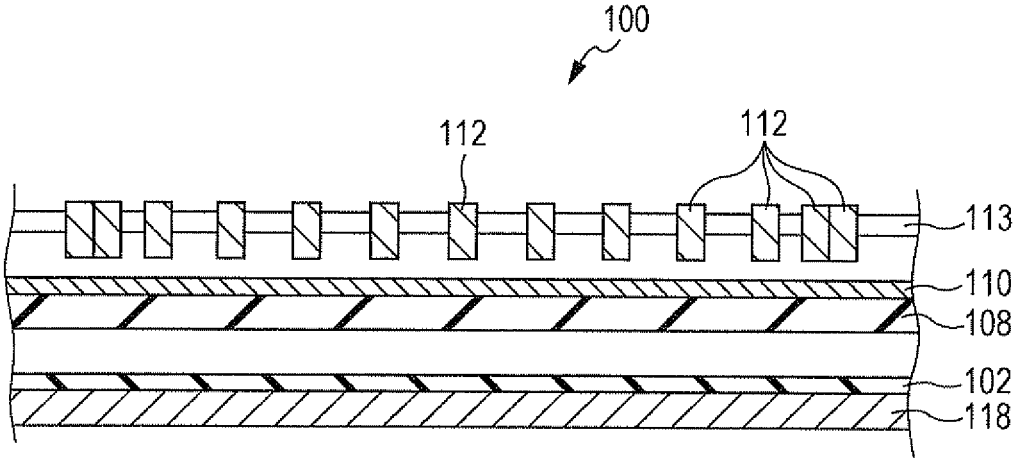
FIG. 10 is a partial sectional view of the fixing unit illustrated in FIG. 9.

As illustrated in FIG. 10, the magnetic path forming members 112 are arranged in the width direction of the fixing belt 102. The magnetic path forming members 112 are held by a holder 113, which is made of a nonmagnetic substance and extends in the width direction of the fixing belt 102. The magnetic path forming members 112 are arranged at a regular pitch in the middle portion of the holder 113 in the longitudinal direction and are arranged at a smaller pitch at both end portions of the holder 113 in the longitudinal direction. The distribution of the magnetic field H in the width direction of the fixing belt 102 is adjusted by such an arrangement the magnetic path forming members 112.

Figure 11:
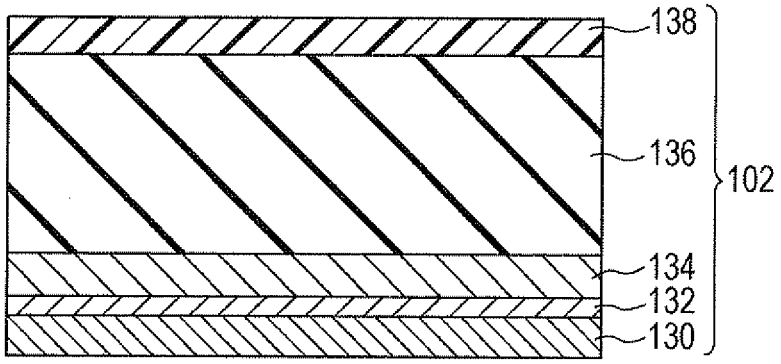
FIG. 11 is a partial sectional view of a fixing belt of the fixing unit illustrated in FIG. 9.

As illustrated in FIG. 11, the fixing belt 102 includes a base layer 130, a heat-generating layer 132, a protective layer 134, an elastic layer 136, and a release coating layer 138, which are stacked in this order from the inside (lower side in FIG. 11) toward the outside (upper side in FIG. 11) and are integrated with each other.

The base layer 130 serves as a base for maintaining the strength of the fixing belt 102. The base layer 130 is made of, for example, a polyimide. Instead of a resin such as a polyimide, the material of the base layer 130 may be a metal such as iron, nickel, silicon, boron, niobium, copper, zirconium, cobalt, or a soft magnetic metal material that is an alloy of such metals.

The heat-generating layer 132 is made of a metal material that generates heat due to electromagnetic induction that induces an eddy current that generates a magnetic field so as to cancel out the magnetic field H. The depth of the heat-generating layer 132 needs to be smaller than the so-called "skin depth" so as to allow the flux of the magnetic field H to pass therethrough. The material of the heat-generating layer 132 may be, for example, gold, silver, copper, aluminum, zing, tin, lead, bismuth, beryllium, antimony, or an alloy of such metals.

The protective layer 134 is made of a material that has a mechanical strength larger than that of the heat-generating layer 132 and that is resistant to repetitive distortions, rust, and corrosion.

The elastic layer 136 is made of a silicone rubber or a fluorocarbon rubber, which has high elasticity and heat resistance.

The release coating layer 138 decreases adhesion between the fixing belt 102 and toner T (see FIG. 9) that is melt on the recording medium P, and thereby allows the recording medium P to be easily removed from the fixing belt 102. The release coating layer 138 is made of a fluorocarbon resin, a silicone resin, or a polyimide resin, which provides a high releasability.

As illustrated in FIG. 9, a support shaft 114 having a quadrangular-prism shape is disposed inside the fixing belt 102. The support shaft 114 is made of aluminum, which is a nonmagnetic substance. The support shaft 114 extends in the width direction of the fixing belt 102 and does not contact the fixing belt 102. Both ends of the support shaft 114 are fixed to the housing 106 of the fixing unit 100. A groove 114A is formed in the bottom surface of the support shaft 114 so as to extend in the longitudinal direction of the support shaft 114. A pressing pad 116 is fit into the groove 114A, and the pressing pad 116 presses the fixing belt 102 outward with a predetermined pressure. The pressing pad 116 is made of an elastic material, and a surface of the pressing pad 116 contacts the inner peripheral surface of the fixing belt 102 and presses the fixing belt 102 outward.

A heat-generating body 118, which has an arc shape, is disposed inside the fixing belt 102 and above the support shaft 114 so as to face the excitation coil 110.

The heat-generating body 118 is a substantially semicylindrical member extending in the width direction of the fixing belt 102, and a surface of the heat-generating body 118 is in contact with the inner surface of the fixing belt 102. The heat-generating body 118 is made of an iron alloy. The magnetic field H generates a closed magnetic path between the magnetic path forming members 112 and the heat-generating body 118, and the heat-generating body 118 generates heat due to electromagnetic induction caused by the magnetic field H.

Two support members 122 are disposed at predetermined positions of the heat-generating body 118 in the longitudinal direction. The support members 122 each have a substantially L-shaped support portion, and the support portions are attached to ends of the inner circumference of the heat-generating body 118.

Figure 12:
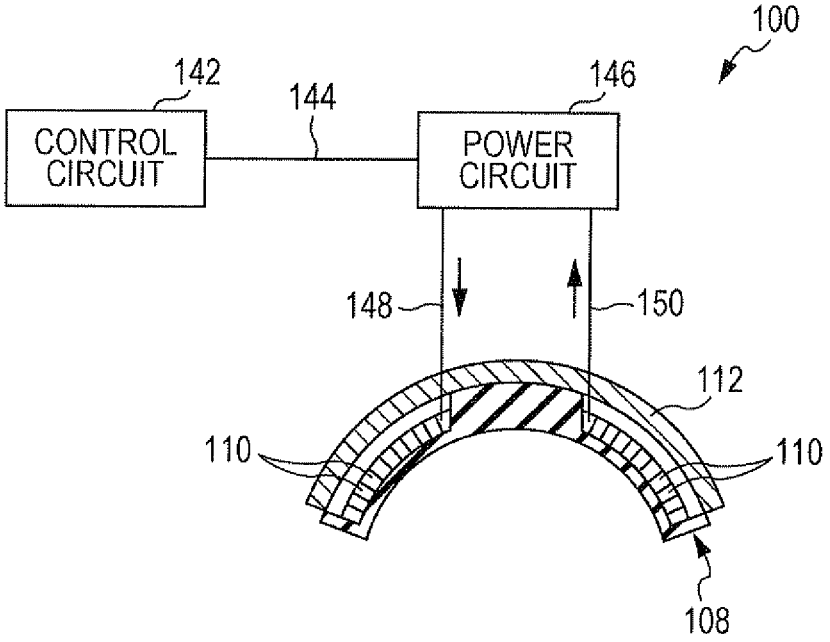
FIG. 12 is a connection diagram of a control circuit and a power circuit of the fixing unit illustrated in FIG. 9.

The controller 20 (see FIG. 8) includes a control circuit 142. As illustrated in FIG. 12, the control circuit 142 is connected to a power circuit 146 through a wire 144. The power circuit 146 is connected to the excitation coil 110 through wires 148 and 150.

The control circuit 142 causes the power circuit 146 to energize the excitation coil 110 and generates the magnetic field H (see FIG. 9), which is a magnetic circuit. The power circuit 146 is turned on or off on the basis of an electric signal sent from the control circuit 142, and supplies or stops supplying an alternate current having a predetermined frequency to the excitation coil 110 through the wires 148 and 150.

As illustrated in FIG. 9, a pressing roller 104 is disposed so as to face the outer peripheral surface of the fixing belt 102. The pressing roller 104 presses the fixing belt 102 against the pressing pad 116, and is rotated in the direction of arrow E by a driving mechanism (not shown) having a motor and a gear.

The pressing roller 104 includes a metal core 105, which is made of a metal such as aluminum, and a silicone rubber and a perfluoroalkoxy (PFA) resin that cover the metal core 105. The pressing roller 104 presses the fixing belt 102 against the pressing pad 116, so that the fixing belt 102 is deformed inward at a contact portion (nip) between the fixing belt 102 and the pressing roller 104.

The nip is curved in a direction such that, when the recording medium P to which toner T adheres passes through the nip, the recording medium P is peeled off the fixing belt 102. Therefore, the recording medium P, which has been transported in the direction of arrow IN, follows the shape of the nip in accordance with the rigidity thereof and is output in the direction of arrow OUT.

The fixing process performed by the fixing unit 100 will be described.

In the fixing unit 100, the controller 20 drives the driving motor (not shown), the pressing roller 104 rotates in the direction of arrow E, and the fixing belt 102 rotates in the direction of arrow D. At this time, the power circuit 146 is driven on the basis of an electric signal from the control circuit 142, and supplies an alternate current to the excitation coil 110.

When the alternate current is supplied to the excitation coil 110, the magnetic field H, which is a magnetic circuit, is generated and dissipated around the excitation coil 110. When the magnetic field H passes through the heat-generating layer 132 of the fixing belt 102, an eddy current is induced in the heat-generating layer 132 so as to generate a magnetic field that cancels out change in the magnetic field H. The heat-generating layer 132 generates heat in proportion to the skin resistance of the heat-generating layer 132 and the amount of eddy current that flows in the heat-generating layer 132, and thereby the fixing belt 102 is heated.

Likewise, the heat-generating body 118 generates due to electromagnetic induction caused by the magnetic field H, and thereby the fixing belt 102 is heated. Thus, the heat-generating layer 132 and the heat-generating body 118 are heated by the same excitation coil 110.

The recording medium P, which has been fed into the fixing unit 100, is heat-pressed by the heated fixing belt 102 and the pressing roller 104, whereby the toner image is fixed onto a surface of the recording medium P. The recording medium P, onto which the toner image has been fixed, is output from the housing 106.

Structure of Winder 252 of Winding Device 250 and Modification of Winder 252

Figure 13A:
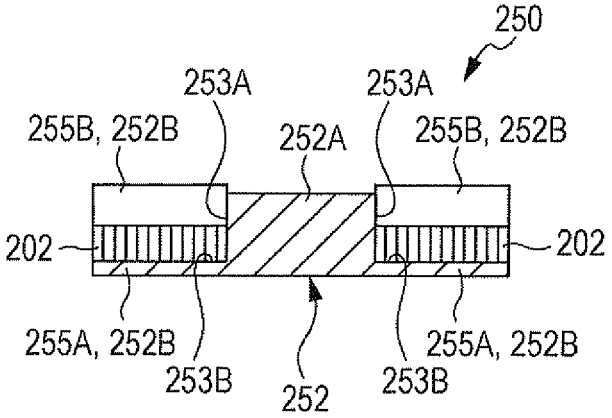
FIGS. 13A to 13C illustrate the structure of a winder according to the exemplary embodiment.
Figure 13B:
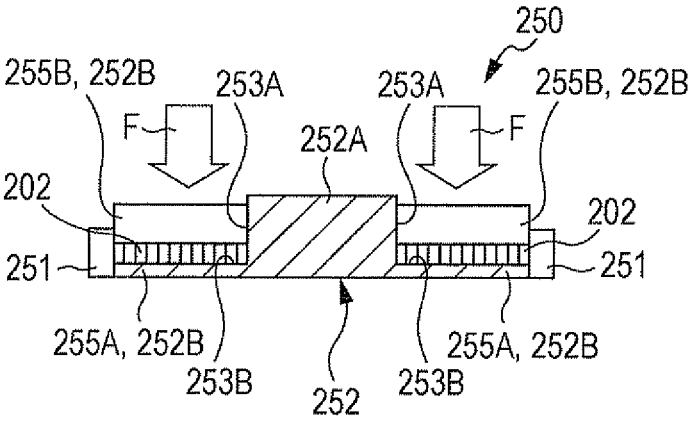
Figure 13C:
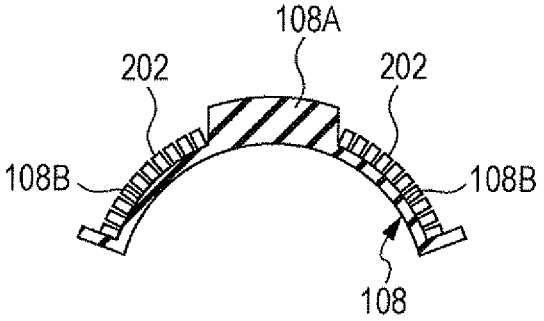
Figure 14A:
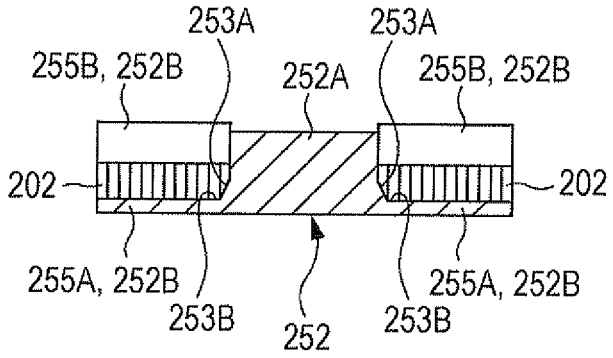
FIGS. 14A to 14C illustrate a modification of the winder.
Figure 14B:
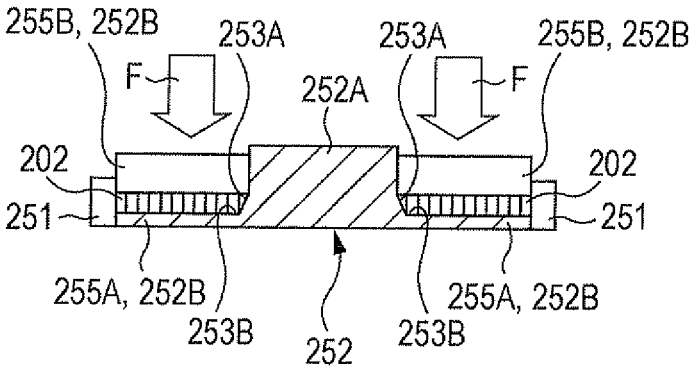
Figure 14C:
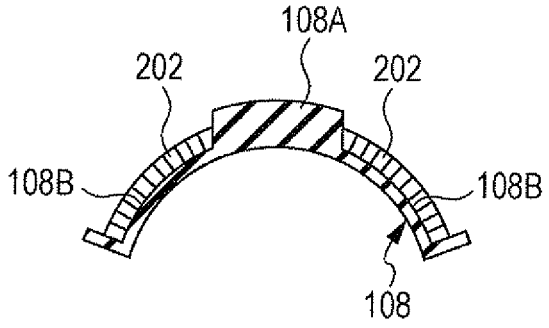

FIGS. 13A to 13C are sectional views illustrating the structure of the winder 252. FIGS. 14A to 14C are sectional views illustrating a modification of the winder 252.

As illustrated in FIGS. 13A and 13B, one of the pair of flanges 252B of the winder 252 of the winding device 250 is a fixed flange 255A that is fixed to the winding shaft 252A and the other of the pair of flanges 252B is a movable flange 255B that is movable to become close to and away from the fixed flange 255A (in vertical directions in FIGS. 13A and 13B). That is, the movable flange 255B functions as a compressing member that compresses the wire 202, which is wound around the winding shaft 252A, in the axial direction of the winding shaft 252A and thereby forms the wire 202.

Side surfaces 253A of the winding shaft 252A (over which the wire 202 is wound) are perpendicular to a surface 253B (a surface that the wire 202 wound around the winding shaft 252A contacts) of the fixed flange 255A.

As illustrated in FIG. 13B, in the process of forming the wire 202 that is wound around the winder 252, the movable flange 255B moves in the axial direction of the winding shaft 252A toward the fixed flange 255A and compresses the wire 202 in a compression direction indicated by arrow F. The movable flange 255B compresses the wire 202 until the height of the wire 202 in the compression direction (vertical direction in FIGS. 13A and 13B) becomes a desired value. At this time, a restraining member 251 contacts the wire 202 from the outside and restrains outward movement of the wire 202.

As illustrated in FIG. 130, after the wire 202 has been formed as described above, the wire 202 is wound around the protruding portion 108A of the bobbin 108 of the fixing unit 100 (see FIG. 9), and the wire 202 is bonded to a surface 108B of the bobbin 108 with an adhesive.

As illustrated in FIGS. 14A and 14B, the winding shaft 252A may have a tapering shape such that the width of the winding shaft 252A decreases gradually from the fixed flange 255A toward the movable flange 255B. To be specific, the width of the winding shaft 252A near an end thereof (near the fixed flange 255A) gradually decreases from the fixed flange 255A toward the movable flange 255B upstream in the compression direction (axial direction of the winding shaft 252A). Therefore, the side surfaces 253A of the winding shaft 252A (over which the wire 202 is wound) are inclined at obtuse angles with respect to the surface 253B of the fixed flange 255A (a contact surface that the wire 202 wound around the winding shaft 252A contacts). Alternatively, the width of not only a part but the entirety of the winding shaft 252A may change.

The width of the winding shaft 252A near the movable flange 255B of the structure illustrated in FIGS. 14A and 14B is smaller than that of the structure illustrated in FIGS. 13A and 13B. A space for holding the wire 202 is increased by the amount by which the width is reduced.

Also in the structure illustrated in FIGS. 14A and 14B, the wire 202 is wound around the winder 252 having a tapering shape (winding process). As illustrated in FIG. 14B, the movable flange 255B moves in the axial direction of the winding shaft 252A toward the fixed flange 255A and compresses the wire 202 as indicated by arrow F (forming process). The movable flange 255B compresses the wire 202 until the height of the wire 202 in the compression direction (in the vertical direction in FIGS. 14A and 14B) becomes a desired value. At this time, the restraining member 251 contacts the wire 202 from the outside and restrains outward movement of the wire 202.

A space for holding the wire 202 in the structure illustrated in FIGS. 14A and 14B is larger than that of the structure illustrated in FIGS. 13A and 13B. Therefore, in the forming process of compressing the wire 202 as indicated by arrow F by moving the movable flange 255B toward the fixed flange 255A as illustrated in FIG. 14B, a force for compressing the wire 202 is reduced as compared with the structure illustrated in FIGS. 13A and 13B.

Moreover, in the forming process illustrated FIG. 14B, the wire 202 is compressed into a shape corresponding to the tapering shape of the winding shaft 252A. Therefore, as illustrated in FIG. 14C, a gap is unlikely to be formed between the protruding portion 108A of the bobbin 108 and the wire 202.

Modification of Process of Forming Wire 202 Wound Around Winding Shaft 252A In the forming process according to a modification, the flange 252B compresses the wire 202, which has been linearly wound around the winding shaft 252A, in the axial direction of the winding shaft 252A and thereby forms the wire 202 (first compression), and a compressing device 360 (see FIG. 15) further compresses the wire 202 as described below and thereby forms the wire 202 (second compression).

The compressive forces in the first and second compressions are determined so that the height of the wire 202 in the compression direction becomes a desired height after the second compression. That is, the compressive force of the first compression, which is performed by using the flange 252B, is determined so that the height of the wire 202 becomes larger than the desired height.

Figure 15:
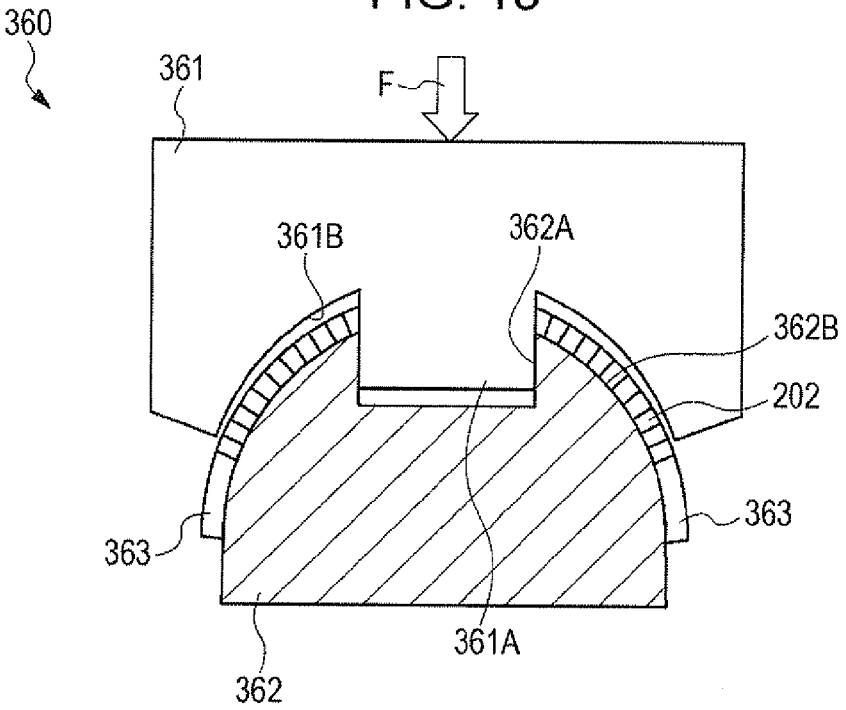
FIG. 15 is a schematic view of a compressing device that is used for second compression of a forming process.

As illustrated in FIG. 15, the compressing device 360 includes a lower die 362 and an upper die 361, which are vertically arranged. The lower die 362 is an example of a supporter that supports the wire in a curved state. The upper die 361 is an example of a compressing body that that compresses the wire supported by the supporter. The lower die 362 has an upper surface 362B having an arc shape that is convex upward. To be specific, the upper surface 362B of the lower die 362 has a shape corresponding to the surface 108B (see FIG. 13C) of the bobbin 108 on which the induction heating coil subjected to the present forming process is mounted. Therefore, the lower die 362 is configured to support the wire 202, which has been compressed by the flange 252B, in a state in which the wire 202 is convexly curved in the compression direction (axial direction).

A recess 362A is formed in the middle of the upper surface 362B of the lower die 362. The protruding portion 361A of the upper die 361 is inserted into the recess 362A.

The upper die 361 is curved so that the lower surface 361B is curved so as to be convex upward. To be specific, the lower surface 361B of the upper die 361 has a shape corresponding to the arc shape of the surface 108B (see FIG. 13C) of the bobbin 108 on which the induction heating coil subjected to the forming process is placed. A protruding portion 361A is formed in the middle of the lower surface 361B of the upper die 361. The protruding portion 361A has a shape corresponding to that of the protruding portion 108A of the bobbin 108. As with the protruding portion 108A of the bobbin 108, the protruding portion 361A has a rectangular shape having long sides extending in a width direction of the recording medium P, which is perpendicular to the transport direction of the recording medium P, in bottom view (when seen from below).

The compressing device 360 is configured so that the upper die 361 moves downward and compresses the wire 202 between the upper die 361 and the lower die 362 as indicated by arrow F (second compression). At this time, the restraining member 363 contacts the wire 202 from the outside and restrains outward movement of the wire 202.

Figure 16:
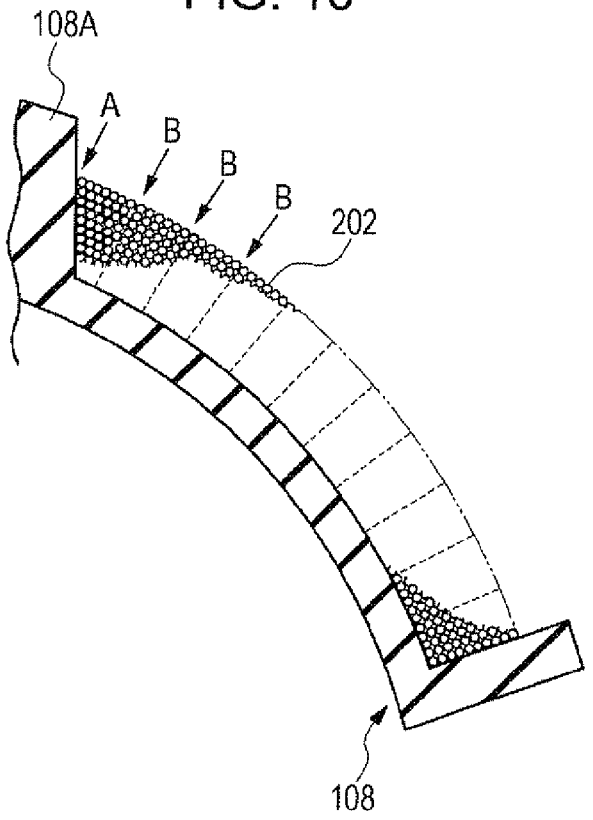
FIG. 16 illustrates a state in which a wire formed by using the compressing device illustrated in FIG. 15 is placed on a bobbin of the fixing unit.

Due to the second compression, the wire 202 is formed into a shape corresponding to that of the bobbin 108. Therefore, as illustrated in FIG. 16, a gap is unlikely to be formed between the protruding portion 108A of the bobbin 108 and the wire 202 (see arrow A) and between turns of the wire 202 (see arrow B) when the wire 202 is placed on the bobbin 108.

Method of Controlling Driving Motor 219 of Wire Supply Unit 210

A method of controlling the driving motor 219 of the wire supply unit 210 will be described.

As described above, the controller 260 causes the driving motor 219 (which is an example of a driver) of the wire supply unit 210 to rotate the bobbin 212, which is an example of a winder and around which the wire 202 is wound, in sync with rotation of the feed rollers 232. Thus, the bobbin 212 rotates and the wire 202 is fed from the bobbin 212. If the rotation speed of the driving motors 234 of the feed rollers 232 is constant, the feed speed of the wire 202 fed by the feed rollers 232 is constant. However, even if the rotation speed of the driving motor 219 of the wire supply unit 210 is constant, the supply amount of the wire 202 supplied by the wire supply unit 210 is not constant, because the supply amount of the wire 202 per one rotation of the bobbin 212 changes in accordance with the remaining amount of the wire 202 wound around the bobbin 212.

Figure 17A:
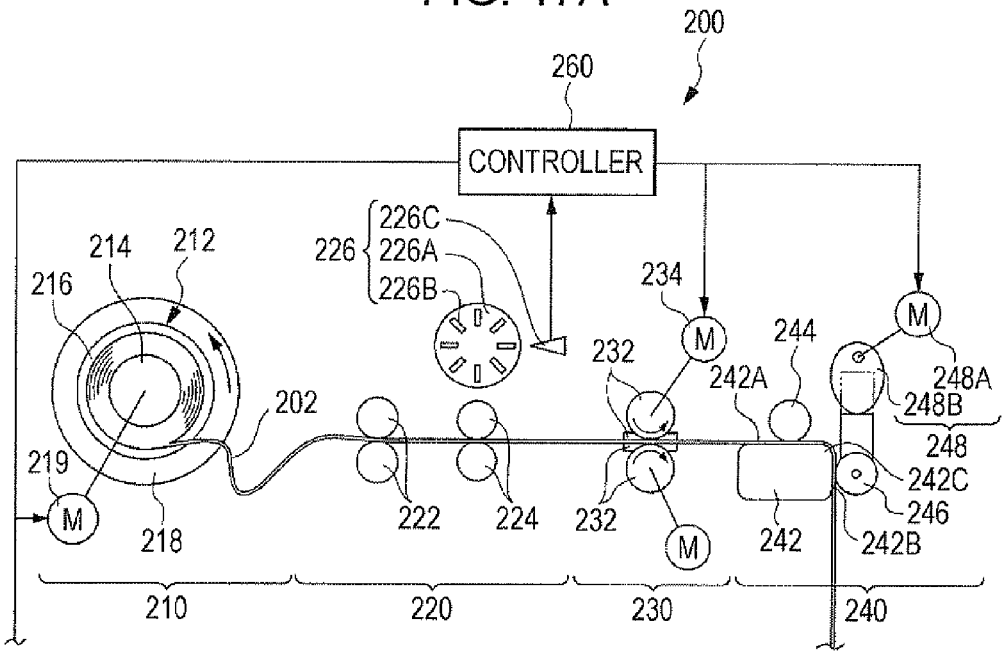
FIG. 17A is schematic view illustrating a state in which a large amount of wire remains in a wire supply unit according to the exemplary embodiment.
Figure 17B:
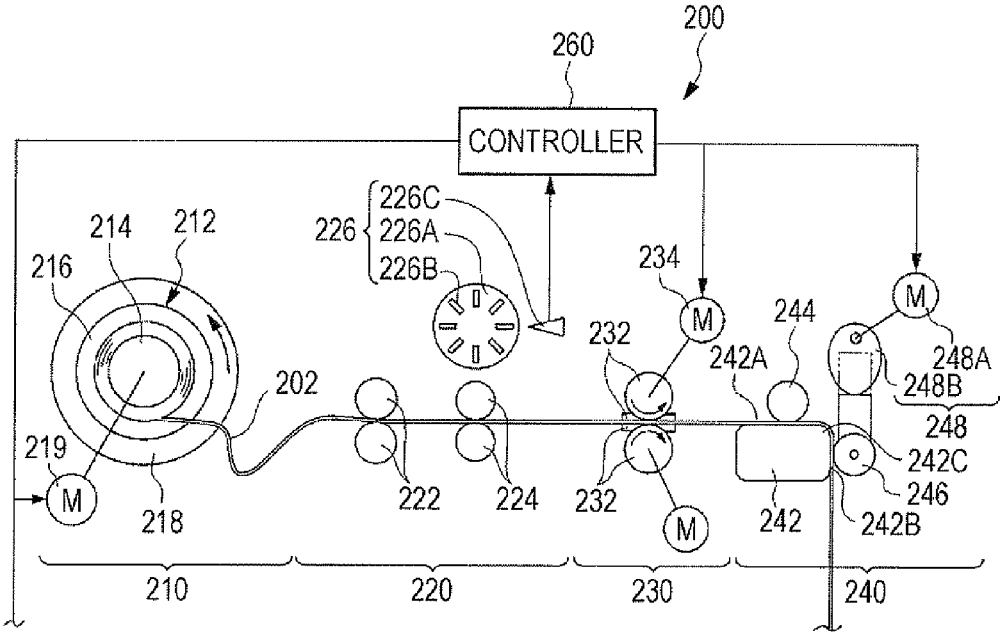
FIG. 17B illustrates a state in which a small amount of wire remains in the wire supply unit.

That is, as illustrated in FIG. 17A, when the remaining amount of the wire 202 wound around the bobbin 212 is large, the supply amount of the wire 202 per one rotation of the bobbin 212 is large. As illustrated in FIG. 17B, as the remaining amount of the wire 202 decreases, the supply amount of the wire 202 wound around the bobbin 212 decreases.

Therefore, the controller 260 calculates the remaining amount of the wire 202 (the length of the circumference of the wire 202 wound around the bobbin=the length of the wire 202 fed from the bobbin when the bobbin rotates once) from the following values: the length measured in the preceding measurement operation (the amount of the wire 202 used to make one induction heating coil in the preceding operation, which is measured by the measuring device 220 from the count number of the rotary encoder 226); and the rotation pulse number that is input to the driving motor (stepping motor) 219 of the wire supply unit 210. Then, the controller 260 sets the rotation speed of the driving motor 219 (the number of rotation pulses that are input per unit time) of the wire supply unit 210 on the basis of the remaining amount of the wire 202.

To be specific, the controller 260 obtains data of (1) to (3) from the preceding measurement operation.

(1) Cp: amount (mm) of the wire 202 used to make one induction heating coil=(count value of the rotary encoder 226 of the measuring device 220)×(feed amount (mm) of the wire 202 per count of the rotary encoder 226 of the measuring device 220)

(2) Mp: rotation pulse number that is input to the driving motor 219 of the wire supply unit 210

(3) R: motor pulse number (set value) (pulse/rotation) for one rotation of the bobbin 212

Next, the controller 260 calculates the remaining amount of the wire 202 (the length of the wire 202 that is fed from the bobbin when the bobbin rotates once) (S (mm/rotation)) by using the following equation (1).

$$S=(Cp\times R)\div Mp \quad (1)$$

Next, the rotation speed V (pulse/sec) of the driving motor 219 of the wire supply unit 210 is calculated from the remaining amount (S) of the wire 202, which is obtained as described above. The rotation speed V (pulse/sec) of the driving motor 219 of the wire supply unit 210 is calculated as $$V=(Vs\div S)\times R,$$

where Vs (mm/sec) is the feed speed of the wire (set value).

With this structure, the bobbin 212 is rotated so that the rotation speed of the bobbin 212 increases as the remaining amount of the wire 202 wound around the bobbin 212 decreases, and the wire 202 is supplied to the feed unit 230 (supplying process). Therefore, even if the remaining amount of the wire 202 changes, the wire 202 is supplied with a feed speed Vs, which has been set by a user, in sync with the rotation of the feed rollers 232.

The initial setting of the rotation speed of the driving motor 219 of the wire supply unit 210 is determined, for example, by measuring beforehand the amount (circumference) of the wire 202 wound around on the bobbin 212 of the wire supply unit 210.

Structure of Another Coil Manufacturing Apparatus 400

Figure 18:
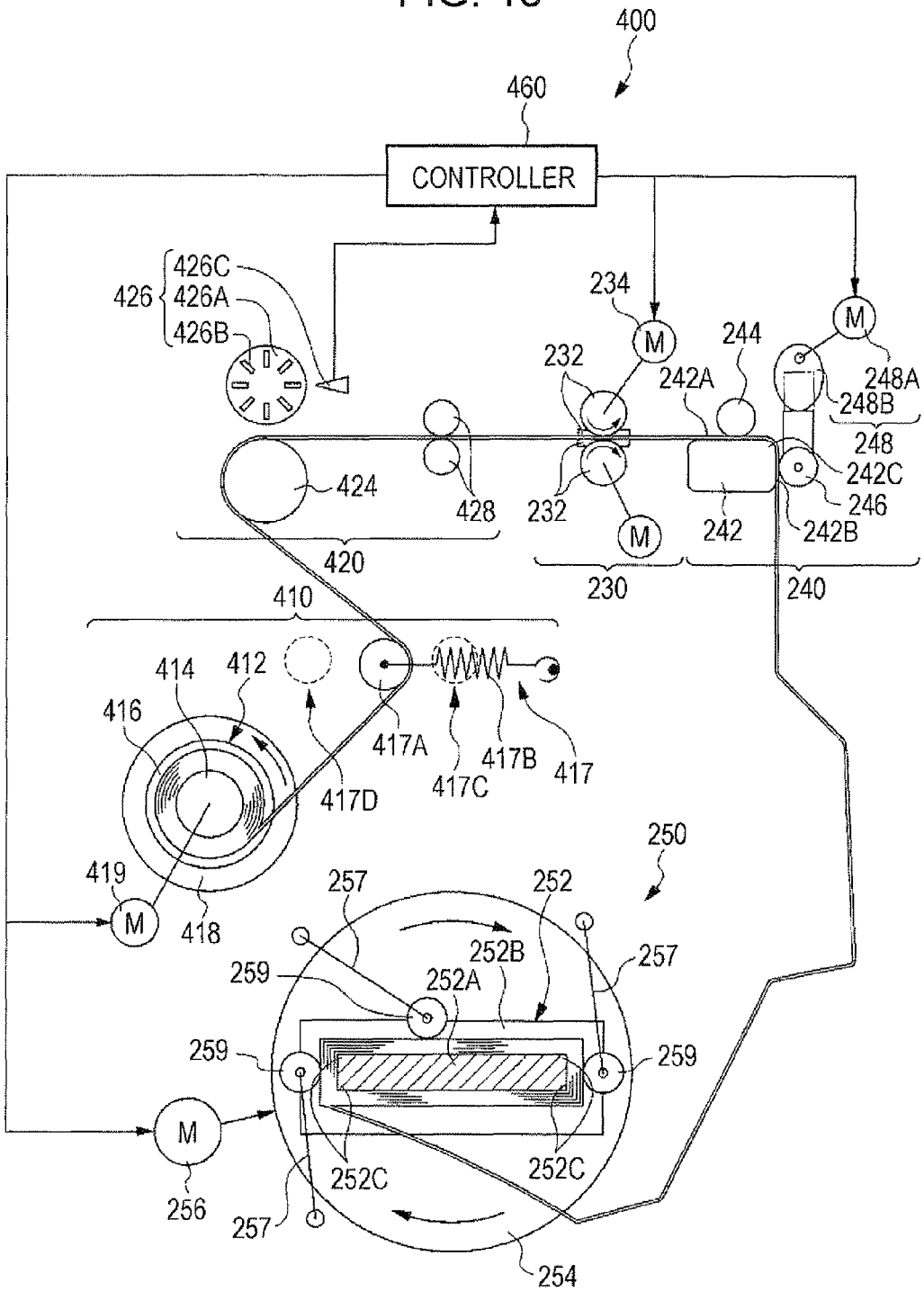
FIG. 18 is a schematic view of a coil manufacturing apparatus according to a modification.

Instead of the coil manufacturing apparatus 200, a coil manufacturing apparatus 400 may be used as a coil manufacturing apparatus that manufactures the induction heating coil. FIG. 18 is a schematic view of the coil manufacturing apparatus 400.

To be specific, as illustrated in FIG. 18, the coil manufacturing apparatus 400 includes a wire supply unit 410 and a measuring device 420, instead of the wire supply unit 210 and the measuring device 220 of the coil manufacturing apparatus 200. The wire supply unit 410 supplies the wire 202 to be bent by the bending device 240. The measuring device 420 measures the feed amount of the wire 202 fed by the feed unit 230. Units and devices the same as those of the coil manufacturing apparatus 200 (the winding device 250, the bending device 240, the feed unit 230, etc.) are denoted by the same numerals and the description thereof will be omitted.

The coil manufacturing apparatus 400 includes a wire supply unit 410, a measuring device 420, the feed unit 230, the bending device 240, and the winding device 250, which are arranged in this order along the feed path of the wire 202.

Wire Supply Unit

As with the wire supply unit 210, the wire supply unit 410 includes a bobbin 412 and a bobbin holder 418. The wire 202 is wound around and held in the bobbin 412. The bobbin holder 418 is a supporter that rotatably supports the bobbin 412.

The bobbin 412 includes a winding shaft 414 and flanges 416. The wire 202 is wound around a winding shaft 414. The flanges 416 are protruding portions that protrude in the radial direction of the winding shaft 414 from both ends of the winding shaft 414 in the axial direction.

The bobbin holder 418 supports the bobbin 412 so that the bobbin 412 is rotatable around the axis of the winding shaft 414.

The bobbin holder 418 has a driving motor 419 that rotates the bobbin 412 in a direction in which the wire 202 is unwound from the winding shaft 414 (counterclockwise in FIG. 18).

The wire supply unit 410 includes a tension applying mechanism 417 that applies a tension to the wire 202 in a direction in which the amount of the wire 202 wound around the driven roller 424, which will be described below, increases. To be specific, the tension applying mechanism 417 includes a support roller 417A and an extension spring 417B. The wire 202 is wound around the support roller 417A, which is an example of a wind member. The extension spring 417B, which is an example of an urging member, urges the support roller 417A in a direction in which a tension is applied to the wire 202 (rightward in FIG. 18). Thus, the tension applying mechanism 417 applies a tension to the wire 202 toward the driven roller 424, which will be described below, (rightward in FIG. 18).

The tension applying mechanism 417 further includes detection sensors 417C and 417D, which are examples of a pair of detectors and which are respectively disposed on an upstream side in the tension applying direction and on a downstream side in the tension applying direction. The detection sensors 417C and 417D are connected to the controller 460, which will be described below, and configured to send a detection signal to a controller 460 when detecting the support roller 417A or the wire 202. The wire supply unit 410 is disposed below the measuring device 420.

Measuring Apparatus

The measuring device 420 includes a driven roller 424 that is rotated in sync with the wire 202 that is fed by the feed unit 230.

The driven roller 424 are disposed upstream of the feed rollers 232 of the feed unit 230 in the feed direction of the wire 202 and downstream of the support roller 417A of the wire supply unit 410 in the feed direction. To be specific, the driven roller 424 is disposed above the support roller 417A and in a horizontal direction of the feed rollers 232.

The material of the driven roller 424 is selected and the pressure with which the drive roller 424 presses the wire 202 is adjusted so that the wire 202 does not easily slip at a contact point at which the wire 202 contacts the driven roller 424 and so that the driven roller 424 are rotated as the wire 202 is fed.

Because the tension applying mechanism 417 applies a tension to the wire 202, a part of the wire 202 between the feed unit 230 and the tension applying mechanism 417 does not become loose, so that the amount of the wire 202 fed by the feed unit 230 is unlikely to deviate from the amount of the wire 202 fed from the position at which the wire 202 is in contact with the driven roller 424.

A rotary encoder 426 for measuring the feed amount of the feed unit 230 is coupled to the driven roller 424. The rotary encoder 426, which is an example of a measuring unit, measures the feed amount of the feed unit 230 on the basis of the rotation of the driven roller 424. The rotary encoder 426 includes a disk 426A that is disposed on the rotary shaft of the driven roller 424 or on a rotary shaft that is rotated by the driven roller 424 through a gear or the like. The disk 426A has slits 426B that extend in the radial direction and that are arranged in the circumferential direction at a predetermined pitch.

The rotary encoder 426 further includes a photointerrupter 426C having a light emitter (not shown) and a light receiver (not shown). The photointerrupter 426C is an example of a detector.

The photointerrupter 426C counts the number of slits 426B that pass between the light emitter and the light receiver by receiving light that is emitted by the light emitter and that passes through the slits 426B, and thereby measures the rotation amount (number of rotations) of the driven roller 424, i.e., the feed amount of the wire 202.

To be specific, the photointerrupter 426C sends a detection signal (pulse signal) generated by receiving light that has passed through the slits 426B to the controller 460 that is connected to the photointerrupter 426C.

Feed rollers 428 that feed the wire 202 are disposed downstream of the driven roller 424 in the feed direction of the wire 202 and upstream of the feed rollers 232 of the feed unit 230 in the feed direction of the wire 202. The feed rollers 428 include a pair of driven rollers that nip the wire 202 therebetween and that are rotated by the wire 202 that is fed.

Controller

In addition to control performed by the controller 260, the controller 460 performs control using the detection sensors 417C and 417D of the tension applying mechanism 417.

To be specific, as with the controller 260, the controller 460 causes the driving motor 419 of the wire supply unit 410 to rotate the bobbin 412 in sync with the rotation of the feed rollers 232. In addition, when the controller 460 receives a detection signal from the detection sensor 417C, which is disposed on the downstream side in the tension applying direction, the controller 460 drives the driving motor 419 so that the amount of the wire 202 supplied by the wire supply unit 410 becomes smaller than the feed amount of the wire 202 fed by the feed unit 230. On the other hand, when the controller 460 receives a detection signal from the detection sensor 417D, which is disposed on the upstream side in the tension applying direction, the controller 460 drives the driving motor 419 so that the amount of the wire 202 supplied by the wire supply unit 410 becomes larger than the feed amount of the wire 202 fed by the feed unit 230.

With this structure, a tension applied to the wire 202 is made constant, so that the extension and contraction of the wire 202 that is being measured by the rotary encoder 426 is prevented. The amount of the wire 202 wound around the driven roller 424 is larger than that with the structure in which the wire 202 is linearly fed. Thus, slipping between the wire 202 and the driven roller 424 is unlikely to occur, and an error between the feed amount of the wire 202 and the rotation amount of the driven roller 424 is unlikely to occur.

The controller 460 may further include the structure described above in "Structure of Winder 252 of Winding Device 250 and Modification of Winder 252". In this case, a constant amount of the wire 202 is supplied further stably.

The present invention is not limited to the exemplary embodiment described above, and may be modified in various ways. For example, the modifications may be used in combination as appropriate.

In the exemplary embodiment, the rotation pulse number that is input to the driving motor (stepping motor) of the wire supply unit 210 is calculated on the basis of the amount of the wire 202 used to make one induction heating coil in the preceding operation. Alternatively, the calculation may be performed plural times while making one induction heating coil.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An induction heating coil manufacturing apparatus comprising:

a winding shaft comprising a quadrangular cross section and a corner, the winding shaft winds a wire around the winding shaft, the wire including stranded wires;

a bending device that bends the wire at a predetermined position at which the wire is to be wound around the corner of the winding shaft so that the bent portion of the wire is predetermined to mate with the corner of the winding shaft before the winding shaft winds the wire at the position around the winding shaft;

a wire supply unit that supplies the wire; and a feed unit that feeds the wire supplied from the wire supply unit to the bending device, wherein a controller controls the winding shaft so that the winding shaft rotates in accordance with a feed amount of the wire fed by the feed unit and winds the wire in so that the wire is not under tension between the winding shaft and the bending device.

2. The induction heating coil manufacturing apparatus according to claim 1, wherein the winding device includes a groove formed in the winding shaft and holding the wire wound around the winding shaft therein, and a pushing member that pushes the wire into the groove in a direction perpendicular to an axial direction of the winding shaft.

3. The induction heating coil manufacturing apparatus according to claim 1, wherein the winding device includes a compressing member that compresses the wire in the axial direction of the winding shaft.

4. The induction heating coil manufacturing apparatus according to claim 3, wherein a shaft width of at least one end portion of the winding shaft tapers in the axial direction of the winding shaft.

5. The induction heating coil manufacturing apparatus according to claim 3, further comprising:

a compressing device including a supporter that supports the wire, which has been compressed by the compressing member, in a state in which the wire is convexly curved in a direction in which the wire has been compressed, and a compressing body that compresses the wire supported by the supporter.

6. The induction heating coil manufacturing apparatus according to claim 1, wherein the feed unit feeds the wire while the winding device winding the wire.

7. An induction heating coil manufacturing method of winding a wire around a winding shaft having a quadrangular cross section, the method comprising:

providing the induction heating coil manufacturing apparatus according to claim 1;

bending the wire, which is to be wound around the winding shaft, at a position at which the wire is to be wound around a corner of the winding shaft; and winding the wire, that has been bent at the position, around the winding shaft.

8. The induction heating coil manufacturing method according to claim 7, wherein the winding winds the wire in a state that the wire is not under tension.

9. The induction heating coil manufacturing method according to claim 7, further comprising:

forming the wire by compressing the wire in the axial direction of the winding shaft after the wire has been wound around the winding shaft.

10. The induction heating coil manufacturing method according to claim 9, wherein the wire is wound by using a winding shaft having a width that tapers in an axial direction at least in one end portion thereof, and wherein the wire is formed by compressing the wire in an axial direction of the winding shaft after the wire has been wound around the winding shaft.

11. The induction heating coil manufacturing method according to claim 9, wherein the forming of the wire by compressing the wire in the axial direction of the winding shaft includes first compression that compresses the wire, which has been linearly wound around the winding shaft, in the axial direction of the winding shaft and second compression that compresses the wire while supporting the wire in a curved state.

12. The induction heating coil manufacturing method according to claim 7, further comprising:

forming the wire into a shape having a quadrangular cross section by compressing the wire.

13. The induction heating coil manufacturing method according to claim 7, further comprising:

supplying the wire, which is to be bent, to the bending device by rotating a winder such that a rotation speed of the winder increases as a remaining amount of the wire wound around the winder decreases.

14. The induction heating coil manufacturing apparatus according to claim 1, wherein the wire supply unit includes:

a winder around which the wire wound, the winder rotating and feeding the wire, and a driver that supplies the wire to the bending device by rotating the winder such that a rotation speed of the winder increases as a remaining amount of the wire wound around the winder decreases.

15. The induction heating coil manufacturing apparatus according to claim 1, further comprising:

a driven roller around which the wire is wound, the driven roller being disposed downstream of the wire supply unit and upstream of the feed unit and rotated by the wire that is fed by the feed unit;

a measuring unit that measures a feed amount of the feed unit on the basis of rotation of the driven roller; and a tension applying mechanism that applies a tension to the wire in a direction such that an amount of the wire wound around the driven roller increases.

* * * * *